US006342152B1

(12) United States Patent
Yoshita

(10) Patent No.: US 6,342,152 B1
(45) Date of Patent: Jan. 29, 2002

(54) HYDROGENATION TREATMENT PROCESS FOR CRUDE OIL AND CRUDE OIL REFORMED THEREBY

(75) Inventor: Mitsuru Yoshita, Chiba-ken (JP)

(73) Assignee: Idemitsu Kosan Co., Ltd., Tokyo (JP)

( * ) Notice: Subject to any disclaimer, the term of this patent is extended or adjusted under 35 U.S.C. 154(b) by 0 days.

(21) Appl. No.: 09/375,467

(22) Filed: Aug. 17, 1999

(30) Foreign Application Priority Data

Aug. 25, 1998 (JP) ..... 10-238735

(51) Int. Cl.[7] ..... C10G 47/02

(52) U.S. Cl. ..... 208/108; 208/108; 208/209; 208/251; 208/213; 208/254 H; 208/216 PP; 208/216; 208/89

(58) Field of Search ..... 208/108, 113, 208/216, 217, 25.11, 134

(56) References Cited

U.S. PATENT DOCUMENTS 4,657,664 A * 4/1987 Evans et al. ..... 208/127
5,009,771 A * 4/1991 Clark et al. ..... 208/216 PP

FOREIGN PATENT DOCUMENTS

| | | |
|---|---|---|
| JP | 5-112785 | 5/1993 |
| JP | 5-230473 | 9/1993 |
| WO | WO 91/01360 | 2/1991 |

* cited by examiner

*Primary Examiner*—Helane E. Myers
(74) *Attorney, Agent, or Firm*—Oblon, Spivak, McClelland, Maier & Neustadt, P.C.

(57) ABSTRACT

There are disclosed a process for hydrogenating treating crude oil in the presence of a catalyst which comprises subjecting crude oil to consecutive hydrogenation demetalling treatment, hydrocracking treatment and hydrodesulfurization treatment to carry out hydrogenation treatment, subsequently carrying out gas-liquid separation in a gas-liquid separation step, and hydroreforming the resultant gas-phase fluid; and reformed crude oil or reformed topped crude oil which is produced by mixing the liquid-phase fluid produced from the gas-liquid separation step and the hydroreformed gas-phase fluid. The process markedly improves the qualities of kerosene and gas oil fractions in the product oil, which are expected to clear the prospectively intensified worldwide regulations on sulfur contents, aromatic components and the like.

14 Claims, 13 Drawing Sheets

HYDROGENATION TREATMENT PROCESS FOR CRUDE OIL AND CRUDE OIL REFORMED THEREBY

BACKGROUND OF THE INVENTION

1. Field of the Invention

The present invention relates to a catalytic hydrogenation treatment process for crude oil and crude oil reformed by the catalytic hydrogenation treatment.

2. Description of the Related Arts

There has heretofore been adopted in an oil refinery industry, a process in which crude oil is distilled into each of fractions, and thereafter each of fractions thus separated is subjected to reforming treatment such as desulfurization. In contrast therewith, there are proposed a process for collectively desulfurizing crude oil as such {refer to Chemical Eng. Progress Vol.67 (8) P.57 (1971)}, a process for collectively desulfurizing the crude oil from which naphtha fraction has been removed {refer to Japanese Patent application Laid-Open No.294390/1991 (Hei-3)} and the like process. According to the above-mentioned process, it is made possible to simplify oil refinery units and besides curtail variable cost of operation, but on the contrary it is made impossible thereby to control in a reactor, the quality per each of the fractions in the oil product. Such control is considered to be extremely difficult from the aspect of its principle.

In addition, the intensified regulation in recent years on the qualities of oil products arising out of the global environmental problems advances at a surprisingly high speed. Such being the case, taking into consideration the prospective regulation on the qualities of the oil products, it has been proved that the foregoing collective desulfurization process not only places a limit on the modification of the qualities of oil products, but also makes the qualities thereof insufficient.

In order to eliminate the disadvantages and defects as mentioned above, there are proposed a process for producing high quality kerosene and gas oil fractions by hydrocracking a heavy oil {refer to Japanese Patent application Laid-Open No. 98270/1994 (Hei-6)} and a method for improving the qualities of kerosene and gas oil fractions by the combination of catalysts for the purpose of hydrogenating treating crude oil or the crude oil from which naphtha fraction has been removed {refer to Japanese Patent application Laid-Open No.268361/1995 (Hei-7), Japanese Patent application Laid--Open No.224890/1992 (Hei-4), Japanese Patent application Laid-Open No.224892/1992 (Hei-4), Japanese Patent application Laid-Open No.27468/1996 (Hei-8), Japanese Patent application Laid-Open No.27469/1996 (Hei-8), etc.}. FIG. 1, FIG. 2, FIG. 3, FIG. 4 and FIG. 5 illustrate the block flow diagrams of the treatment processes.

However, the globally intensified regulation on the qualities of oil products is advancing at unexpectedly high speed as mentioned hereinbefore. For example, in the case of Europe, the sulfur content of gas oil is limited to 500 ppm at the present time, but is required to decrease to 350 ppm in A.D. 2000 and to 50 ppm in A.D. 2005. The polycyclic aromatic series is not limited at the present time, but a proposal of limitation thereof to at most 11% by weight in A.D. 2000 has recently been passed in the European Parliament. These regulations are predicted to spread also through Japan in near future.

There is the possibility of meeting the regulations of up to A.D. 2000 even through the foregoing treatment processes by contriving the combination of operational conditions and catalysts. However it is extremely difficult to cope with the European regulations of A.D. 2005 insofar as the hydrogenation treatment is carried out in the coexistence of a heavy oil.

SUMMARY OF THE INVENTION

A general object of the present invention is to provide a process for hydrogenating treating relatively inferior crude oil or the crude oil from which naphtha fraction has been removed without dividing in advance, the crude oil into each of fractions by means of distillation and also to provide reformed crude oil, said process being characterized by its being a hydroreforming process capable of markedly improving the qualities of kerosene and gas oil, fractions and at the same time, controlling the qualities thereof satisfying the prescribed target.

In this connection, it has been found by the present inventors that by subjecting crude oil or the crude oil from which naphtha fraction and the fractions more light than the same (hereinafter referred to as "Naphtha fraction") have been removed (hereinafter referred to as "topped crude oil") in the presence of a catalyst to consecutive hydrogenation demetalling treatment, hydrocracking treatment and hydrodesulfurization treatment to carry out hydrogenation treatment, subsequently carrying out gas-liquid separation in a gas-liquid separation step, and hydroreforming the resultant gas-phase fluid. The present invention has been accomplished by the above-mentioned findings and information.

Specifically, the gist and outline of the the present invention are as follows.

(1) A process for hydrogenating treating crude oil in the presence of a catalyst which comprises subjecting crude oil to consecutive hydrogenation demetalling treatment, hydrocracking treatment and hydrodesulfurization treatment to carry out hydrogenation treatment, subsequently carrying out gas-liquid separation in a gas-liquid separation step, and hydroreforming the resultant gas-phase fluid.

(2) The process for hydrogenating treating crude oil in the same manner as in the preceding item (1), wherein said crude oil is the topped crude oil from which Naphtha fraction has been removed in a naphtha fraction separation step.

(3) The process for hydrogenating treating crude oil as set forth in the preceding item (2), wherein the Naphtha fraction which has been removed from the crude oil in a naphtha fraction separation step is subjected to hydroreforming together with the gas-phase fluid which has been separated from liquid in the gas-liquid separation step.

(4) The process for hydrogenating treating crude oil as set forth in any of the preceding items (1) to (3), wherein the catalyst used in the hydrocracking treatment is at least one species selected from the group consisting of the metals belonging to group 6, group 8, group 9 and group 10 in the Periodic Table, respectively, and is supported on a carrier composed of 10 to 90% by weight of iron-containing alumino-silicate and 90 to 10% by weight of an inorganic oxide.

(5) The process for hydrogenating treating crude oil as set forth in any of the preceding items (1) to (4), wherein the gas-phase fluid in the course of gas-liquid separation step and the gas-phase fluid after the gas-liquid separation step are subjected to a hydroreforming step at a pressure in the range lower than that in the hydrodesulfurization step by 0 to 50 kg f/cm$^2$ and at a temperature in the range lower than that in said step by 0 to 100° C.

(6) Reformed crude oil or reformed topped crude oil which is produced by mixing the liquid-phase fluid formed from the gas-liquid separation step as set forth in any of the preceding items (1) to (5), and the hydrogenatedly reformed gas-phase fluid.

(7) Mixed reformed crude oil which is produced by mixing the topped crude oil which has been reformed in the process as set forth in any of the preceding items (2), (4) and (5), and the Naphtha fraction which has been separated in the naphtha separation step.

(8) Mixed reformed crude oil as set forth in the preceding item (7), which is produced by mixing the Naphtha fraction which has been separated in the naphtha separation step and thereafter hydrodesulfurized, and the topped crude oil which has been reformed.

(9) The process for hydrogenating treating crude oil as set forth in any of the preceding items (1) to (5), wherein part of distillate which is produced by distilling separating any of the reformed crude oil, reformed topped crude oil and the mixed reformed crude oil as set forth in any of the preceding items (6) to (8), is recycled to the hydroreforming step for the gas-phase fluid.

DESCRIPTION OF SYMBOLS

Figure 1:
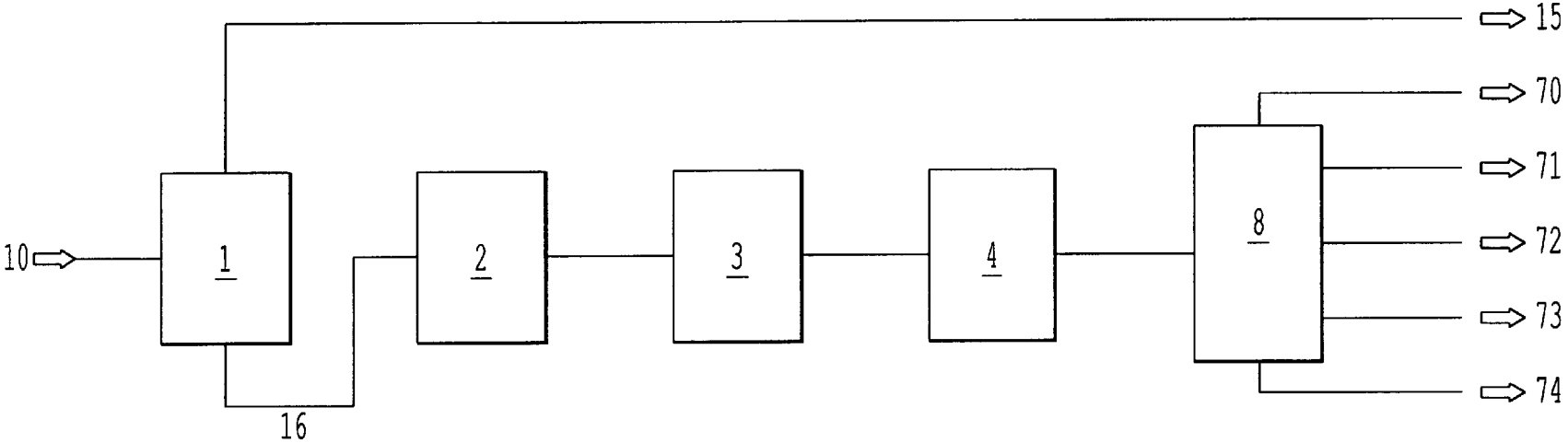
FIG. 1 is a block flowsheet of a crude oil treatment disclosed in Japanese Patent Application Laid-Open No.268361/1995 (Hei-7)
Figure 2:
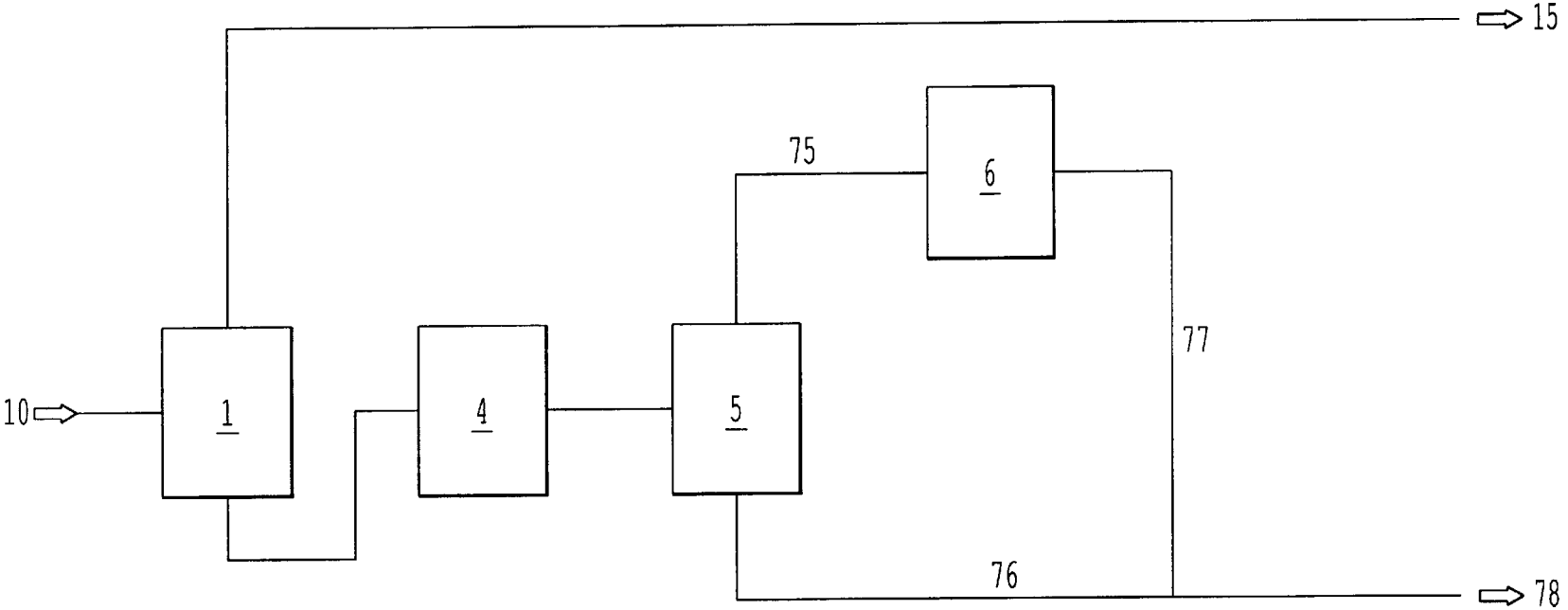
FIG. 2 is a block flowsheet of a crude oil treatment disclosed in Japanese Patent Application Laid-Open No.224890/1992 (Hei-4)
Figure 3:
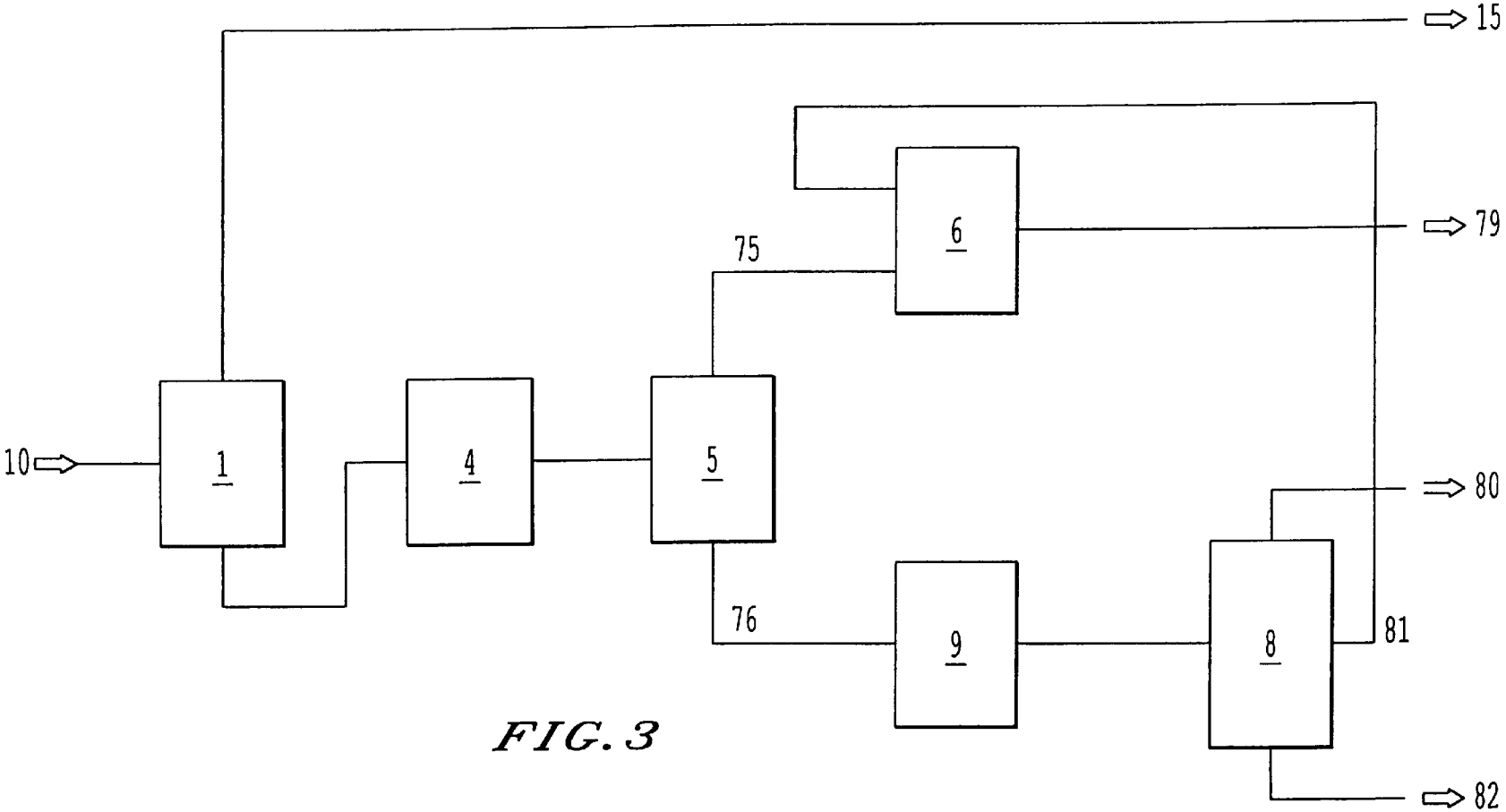
FIG. 3 is a block flowsheet of a crude oil treatment disclosed in Japanese Patent Application Laid-Open No.224892/1992 (Hei-4)
Figure 4:
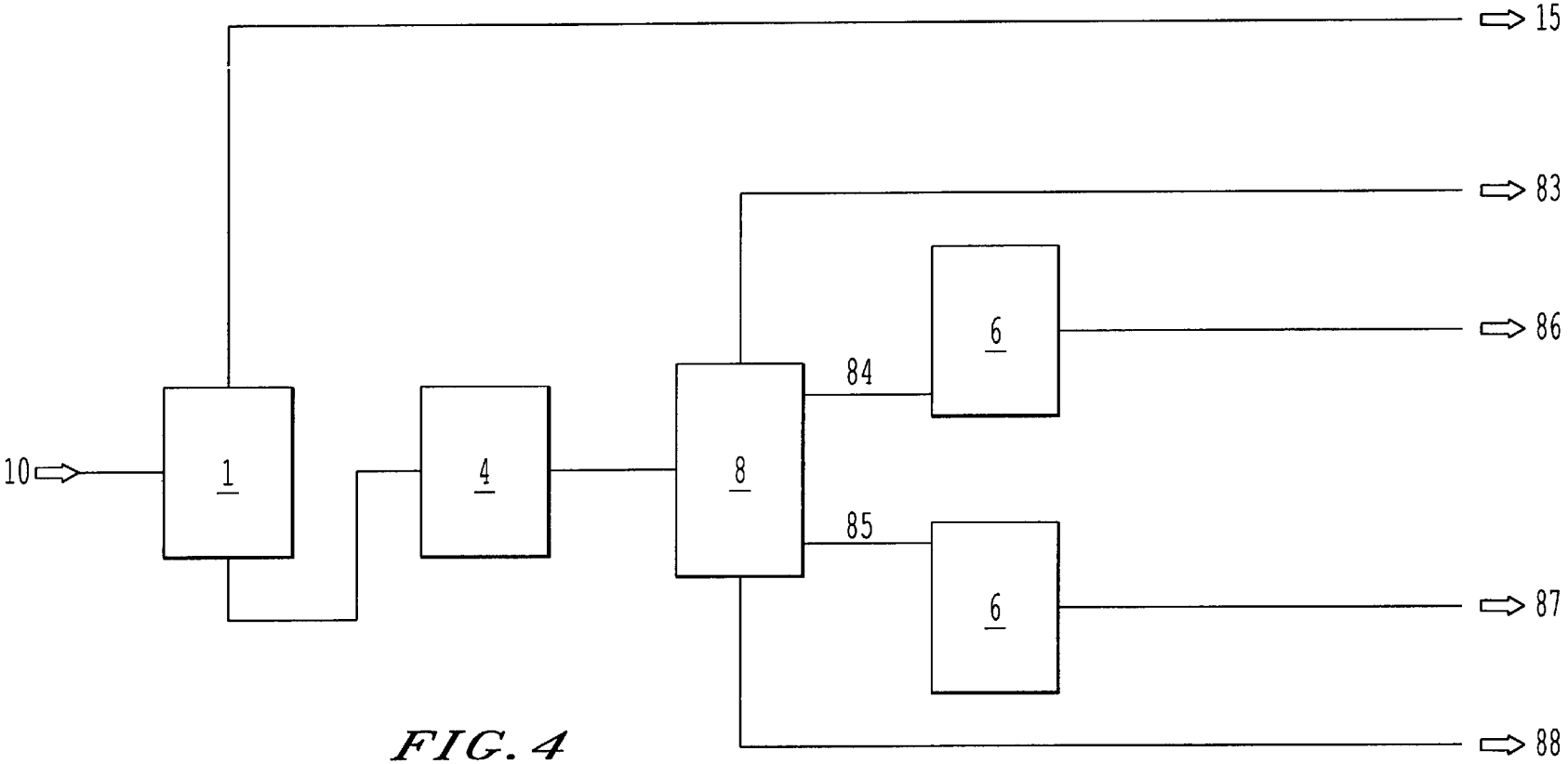
FIG. 4 is a block flowsheet of a crude oil treatment disclosed in Japanese Patent Application Laid-Open No.27469/1996 (Hei-8)
Figure 5:
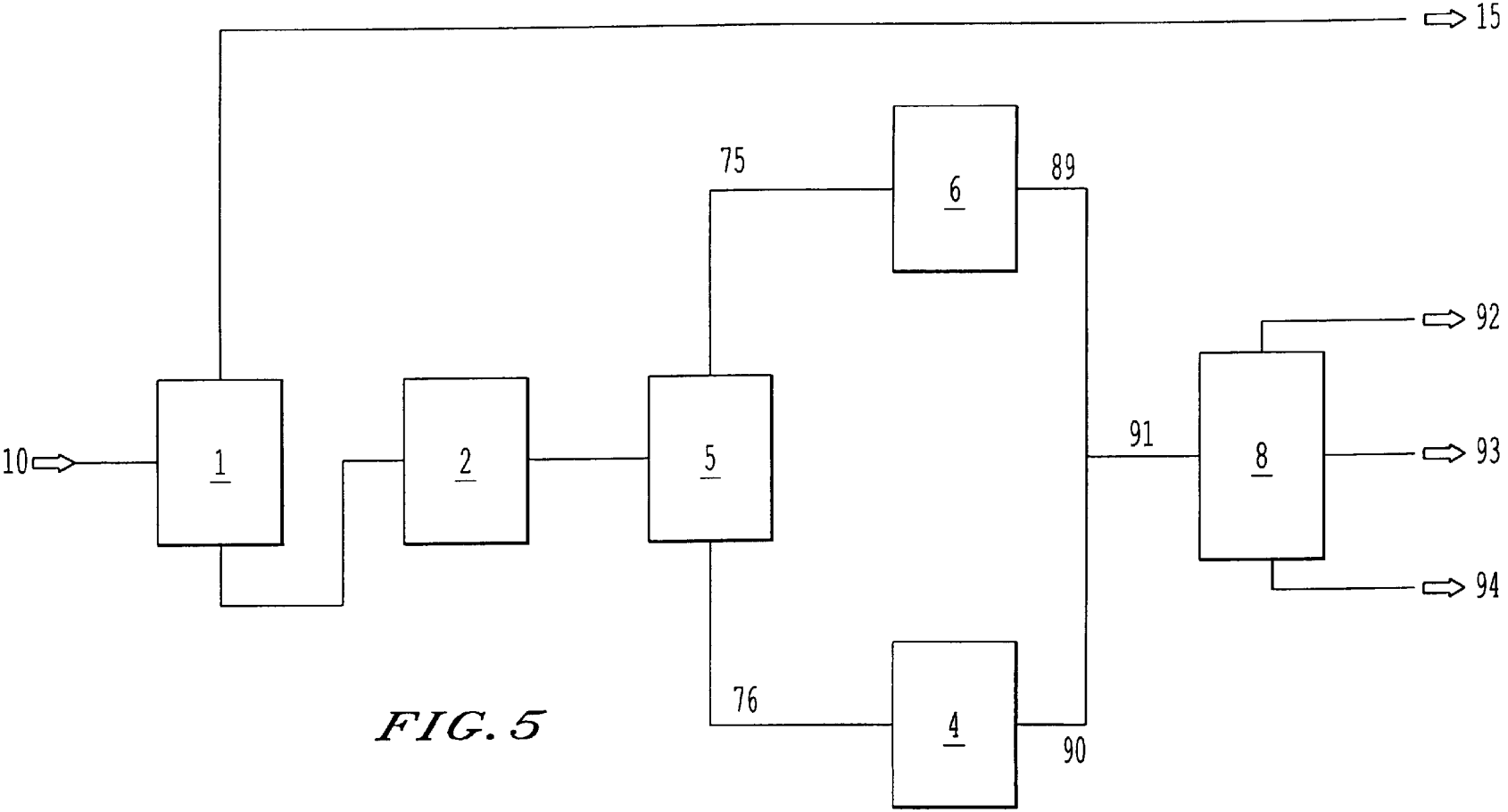
FIG. 5 is a block flowsheet of a crude oil treatment disclosed in Japanese Patent Application Laid-Open No.27468/1996 (Hei-8)

1: naphtha fraction separation step
2: hydrogenation demetalling step
3: hydrocracking step
4: hydrodesulfurization step
5: gas-liquid separation step
6: hydroreforming step
7: hydrodesulfurization step for Naphtha fraction
8: distillation step
9: fluidized catalytic cracking step
10: crude oil
11: gas-phase fluid
12: liquid-phase fluid
13: hydroreformed gas-phase fluid
14: reformed crude oil
15: naphtha fraction and lighter fraction separated in the naphtha fraction separation step
16: topped crude oil
17: gas-phase fluid
18: liquid-phase fluid
19: hydroreformed gas-phase fluid
20: reformed topped crude oil
21: hydroreformed gas-phase fluid including naphtha fraction
22: mixed reformed crude oil
23: desulfurized naphtha
24: mixed reformed crude oil
30: LPG, gas
31: naphtha
32: kerosene
33: gas oil
34: residue (fuel oil)
35: hydroreformed qas-phase fluid
36: reformed crude oil
40: LPG, gas
41: naphtha
42: kerosene
43: gas oil
44: residue (fuel oil)
45: hydroreformed gas-phase fluid
46: reformed topped crude oil
50: LPG, gas
51: naphtha
52: kerosene
53: gas oil
54: residue (fuel oil)
55: hydroreformed gas-phase fluid
56: mixed reformed crude oil
60: LPG, gas
61: naphtha
62: kerosene
63: gas oil
64: residue (fuel oil)
65: hydroreformed gas phase fluid
66: reformed stripped crude oil
70: LPG, gas
71: naphtha
72: kerosene
73: gas oil
74: residue (fuel oil)
75: gas-phase fluid
76: liquid-phase fluid
77: hydroreformed gas-phase fluid
78: reformed crude oil
79: hydroreformed gas-phase fluid
80: gasoline
81: cracked gas oil
82: cracked residue
83: naphtha
84: kerosene
85: gas oil
86: reformed kerosene
87: reformed gas oil
88: residue

89: hydroreformed gas-phase fluid
90: hydrodesulfurized liquid-phase fluid
91: reformed crude oil
92: light fraction
93: intermediate fraction
94: residue

DESCRIPTION OF THE PREFERRED EMBODIMENTS

Figure 6:
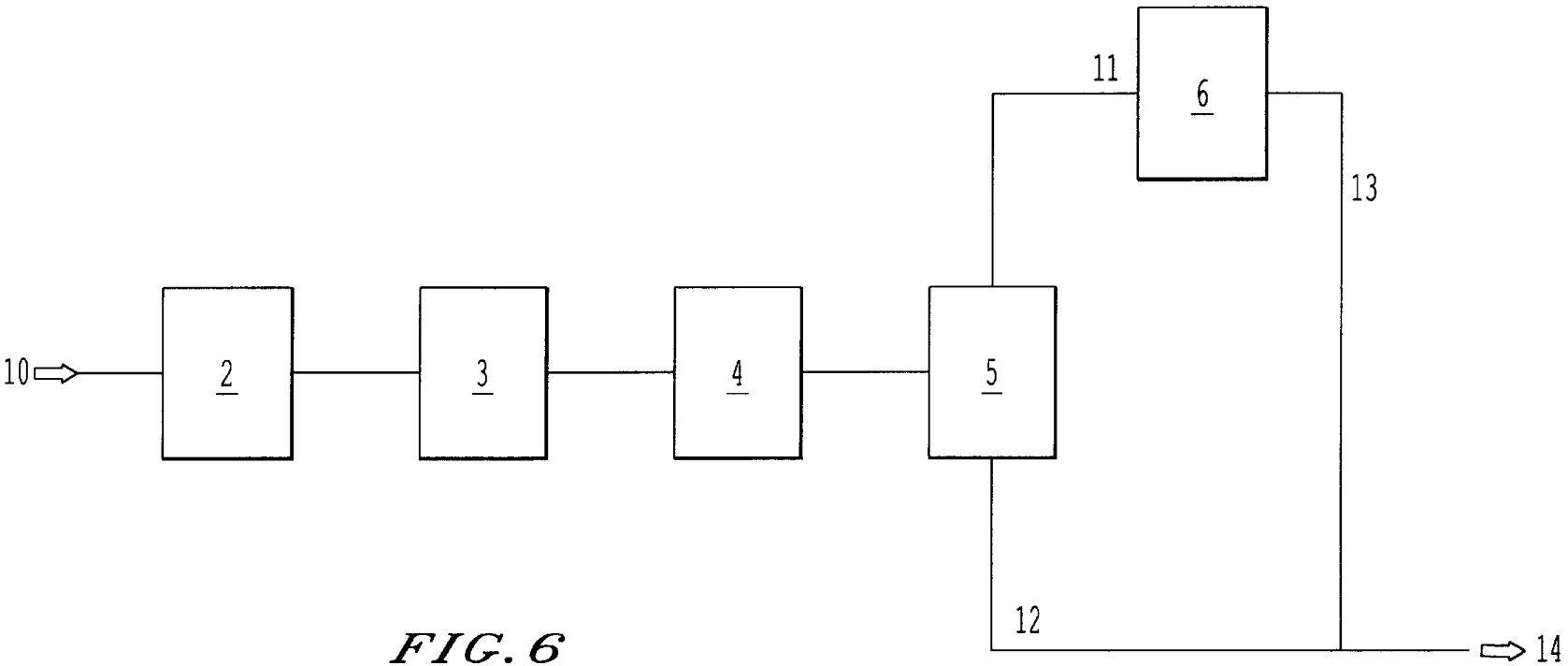
FIG. 6 is a block flowsheet of a process for treating crude oil according to the present invention (1)

FIG. 6 illustrates a block flowsheet of the embodiment for the preceding items (1) in the process for hydrogenating treating crude oil according to the present invention. Detailed description will be given of said process with reference to FIG. 6. The crude oil 10 is at first, treated in a hydrogenation demetalling step 2 in the presence of hydrogen under the conditions as set forth hereinafter, and then is subjected to hydrogenation treatment in a hydrocracking step 3 and a hydrodesulfurization step 4 under the treatment conditions as described hereinafter. The crude oil thus treated is separated into gas-phase fluid 11 and liquid-phase fluid 12 in a gas-liquid separation step 5. The gas-phase fluid 11 is subjected to hydroreforming treatment in the presence of hydrogen in a hydroreforming step 6 under the treatment conditions as described hereinafter. The mixed fluid 14 of the hydroreformed gas-phase fluid 13 and the liquidphase fluid 12 is made to be the reformed crude oil in the above-mentioned embodiment (6) according to the present invention.

The object of the present invention in the embodiment (1) is not attained even if any one of the above-mentioned steps is lacking, or the order of any one of the steps differs therefrom. However, any of various treatment steps may be incorporated before or after or among the steps. For example, it is possible that a hydrogenation demetalling step 2 is followed by a preliminary hydrodesulfurization step, which is further followed by the next steps including a hydrocracking step 3 and a hydrodesulfurization step 4. The hydrogen for the purpose of hydrogenation can be utilized in the next hydro-cracking step 3 and the like without being separated by mixing in advance, an excessive amount of hydrogen over the necessary amount in the crude oil 10 usually before the hydrogenation demetalling step 2. In the case where any of the steps is devoid of necessary hydrogen, supplementary hydrogen needs only to be added thereto.

Figure 7:
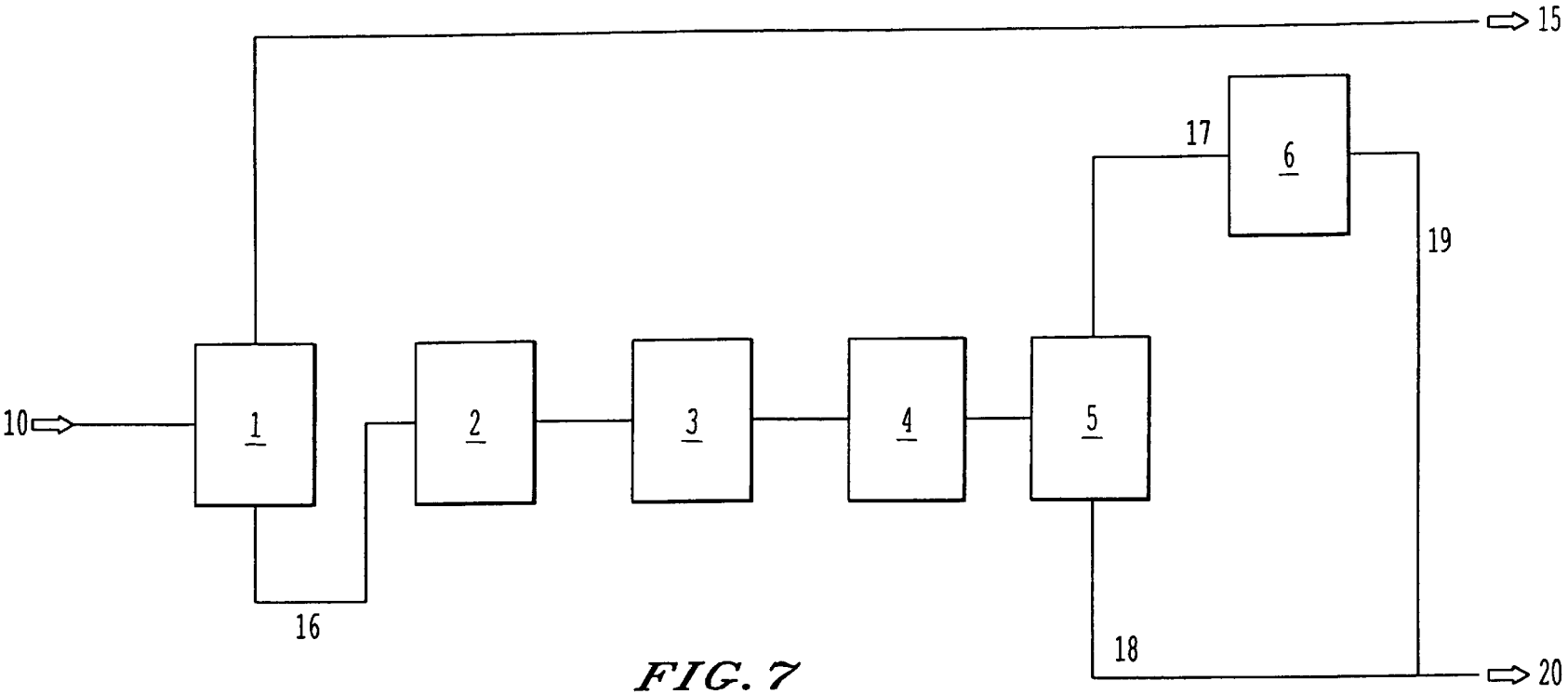
FIG. 7 is a block flowsheet of a process for treating crude oil according to the present invention (2)

Likewise, FIG. 7 illustrates a block flowsheet of the embodiment for the preceding items (2) in the process for hydrogenating treating a topped crude oil 16 which is obtained by separating Naphtha fraction from the crude oil in a naphtha fraction separation step 1 according to the present invention. In addition, the reformed topped crude oil 20 as shown in FIG. 7 becomes the reformed topped crude oil in the embodiment for the preceding items (6) according to the present invention. The mixture of Naphtha fraction which is obtained by separating Naphtha fraction in the naphtha fraction separation step. 1 (naphtha 15) and the reformed topped crude oil 20 becomes the mixed reformed crude oil in the embodiment for the preceding items (7) according to the present invention. FIG. 7 includes the naphtha fraction separation step 1. In the present invention, the naphtha 15 which is separated in the naphtha fraction separation step 1 contains not only naphtha fraction but also fractions more light than the naphtha fraction.

Figure 8:
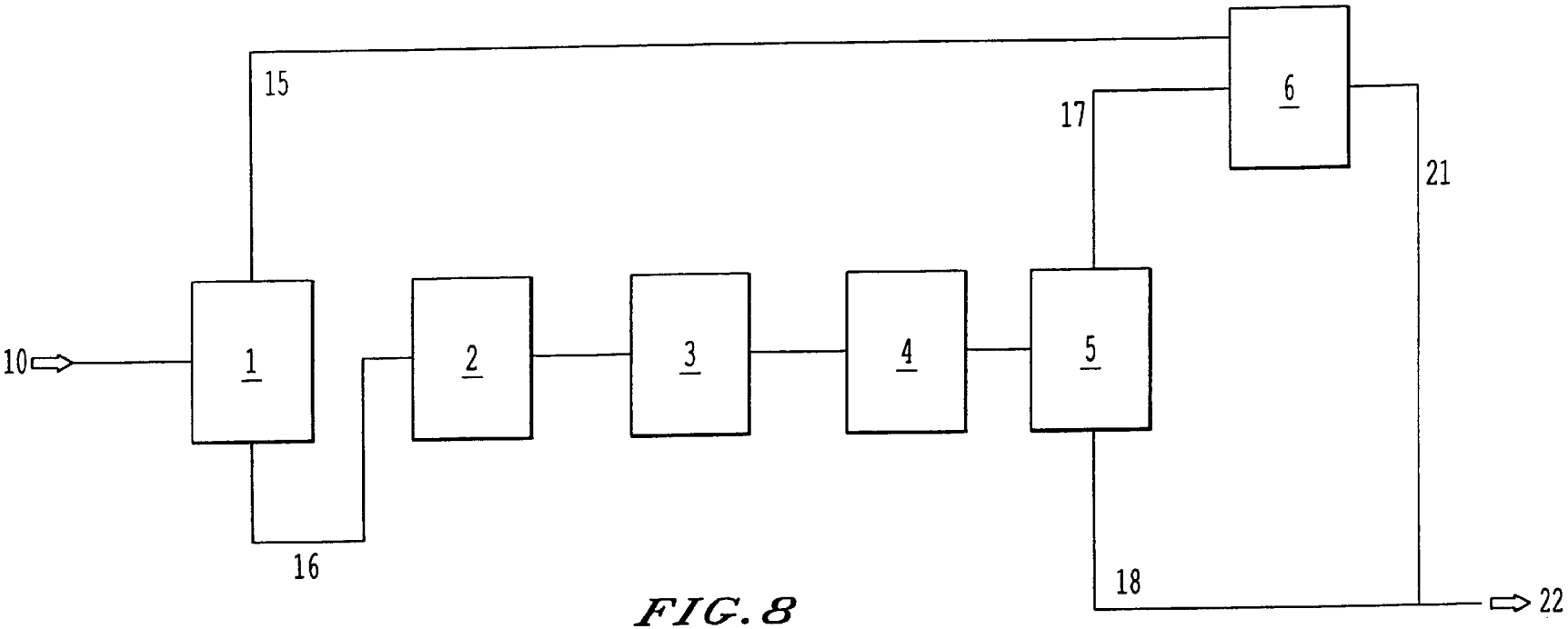
FIG. 8 is a block flowsheet of a process for treating crude oil according to the present invention (3)
Figure 9:
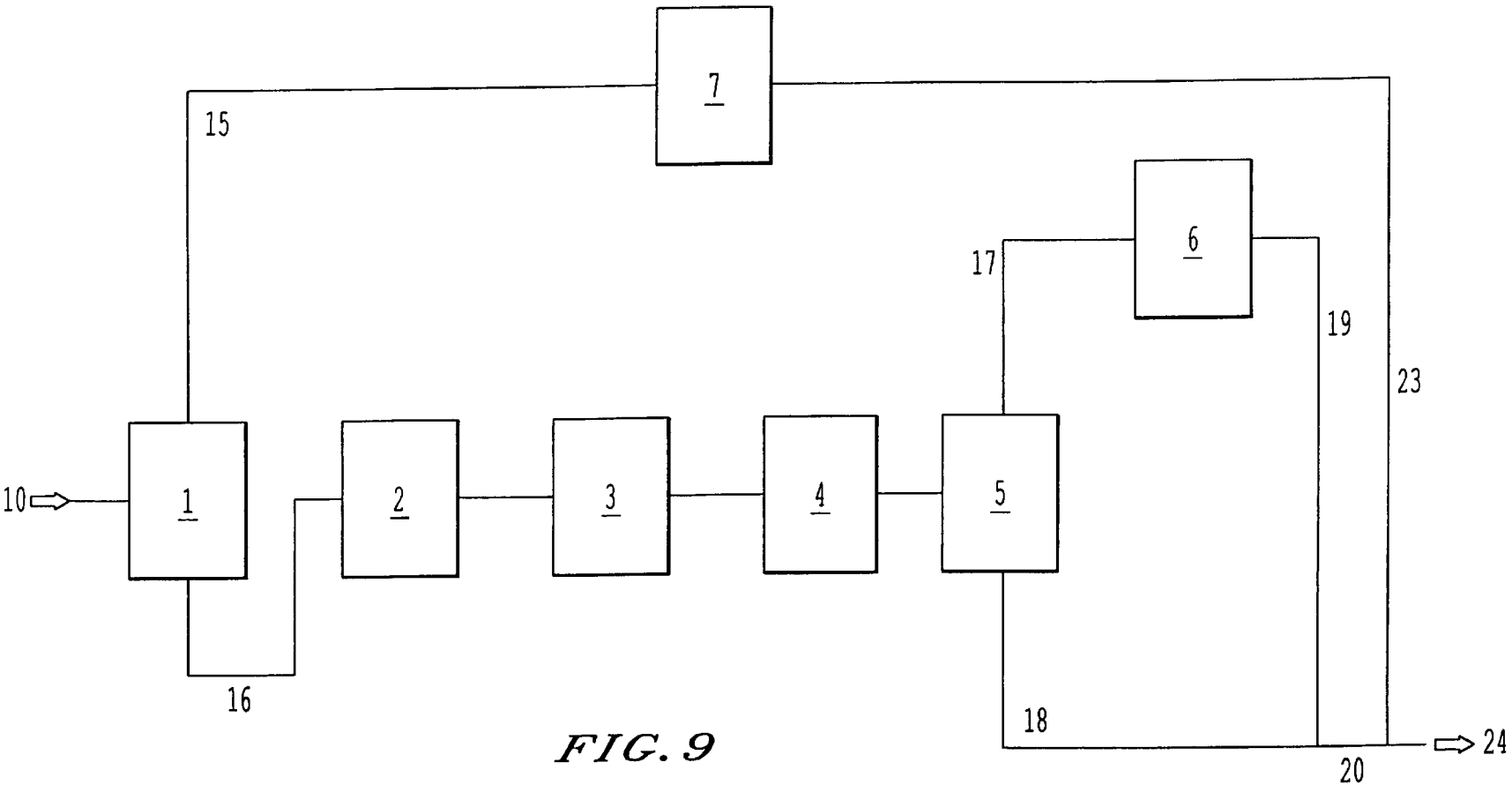
FIG. 9 is a block flowsheet of a process for producing mixed reformed crude oil according to the present invention (8)
Figure 10:
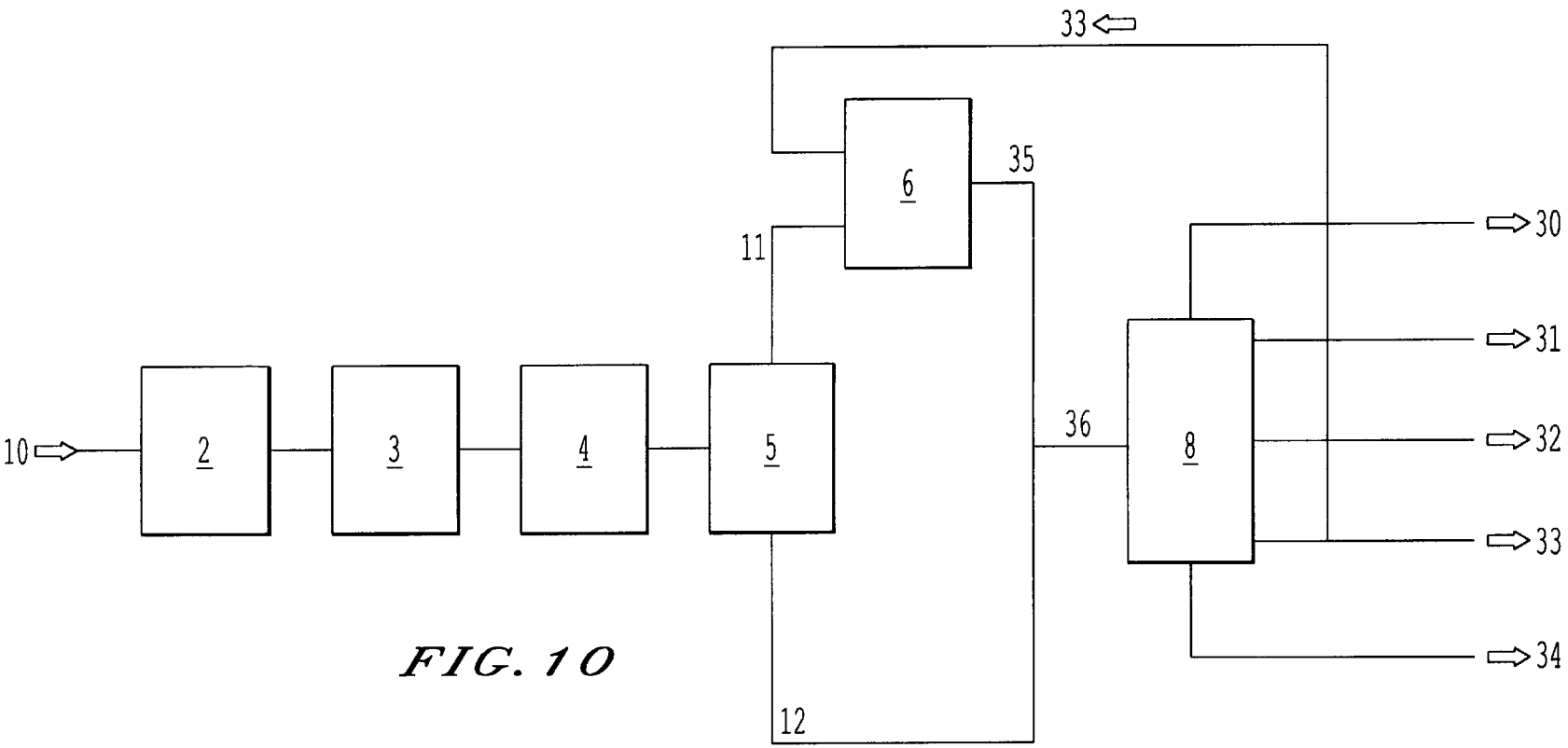
FIG. 10 is a block flowsheet of a process for treating crude oil according to the present invention (9)
Figure 11:
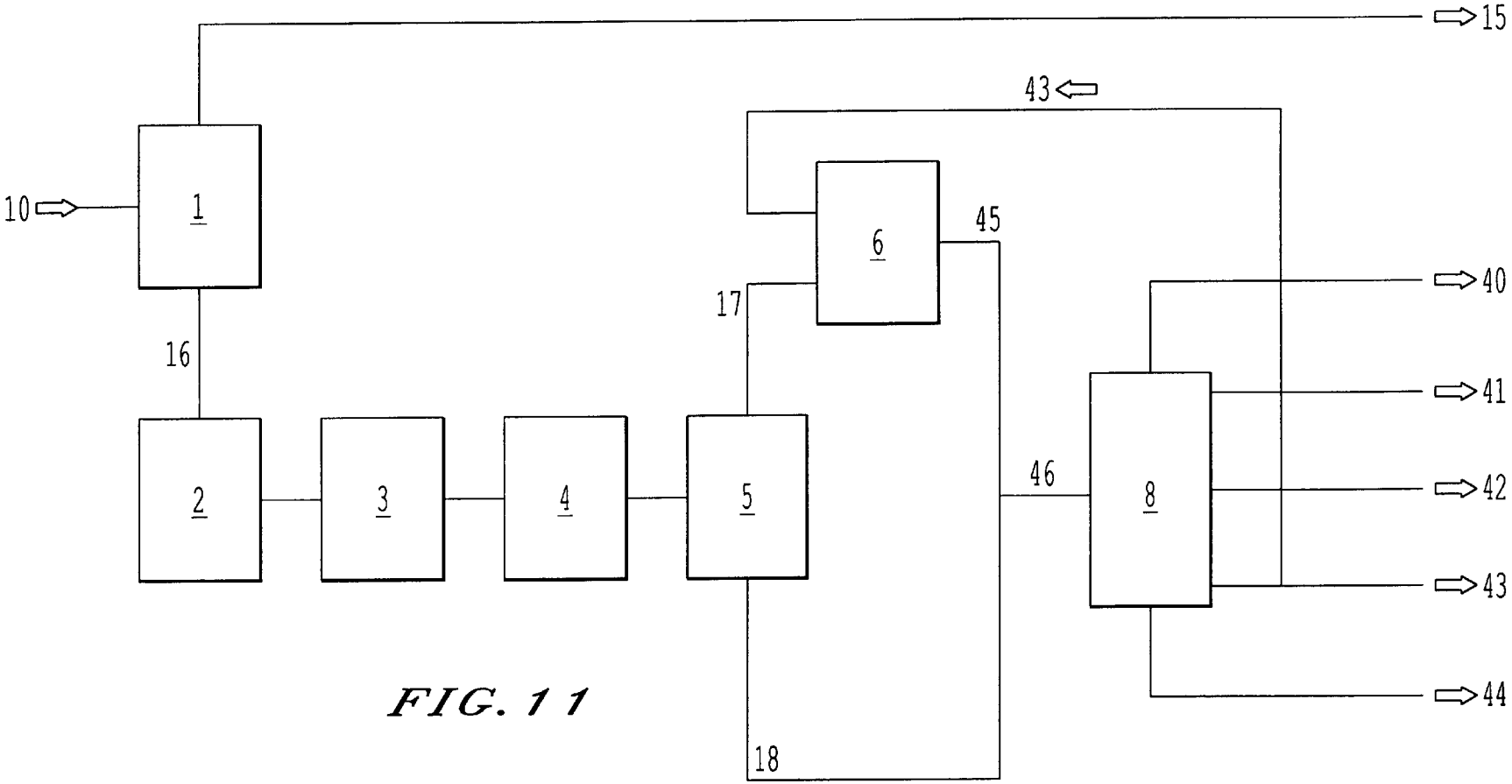
FIG. 11 is a block flowsheet of a process for treating crude oil according to the present invention (9)
Figure 12:
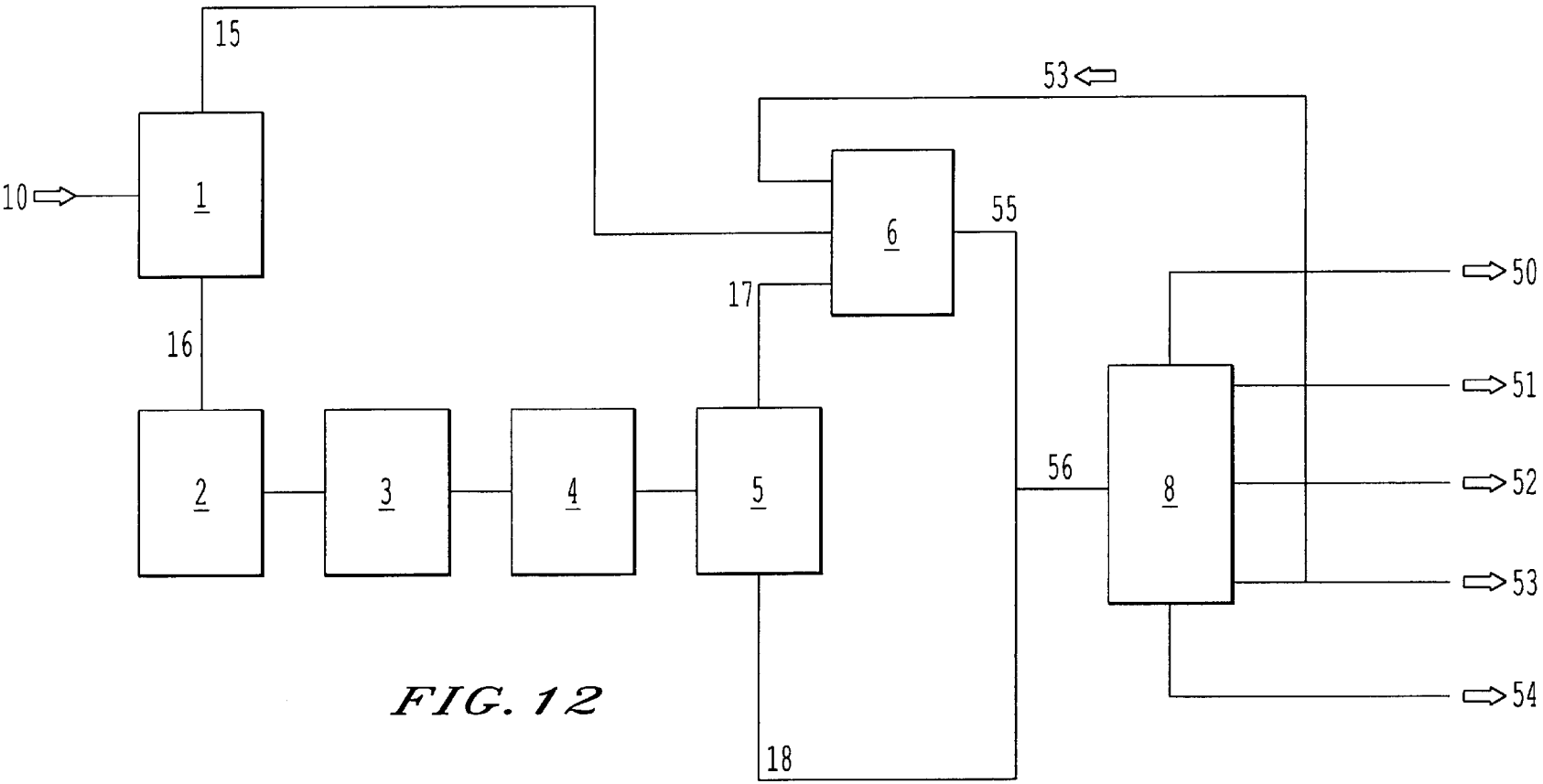
FIG. 12 is a block flowsheet of a process for treating crude oil according to the present invention (9)
Figure 13:
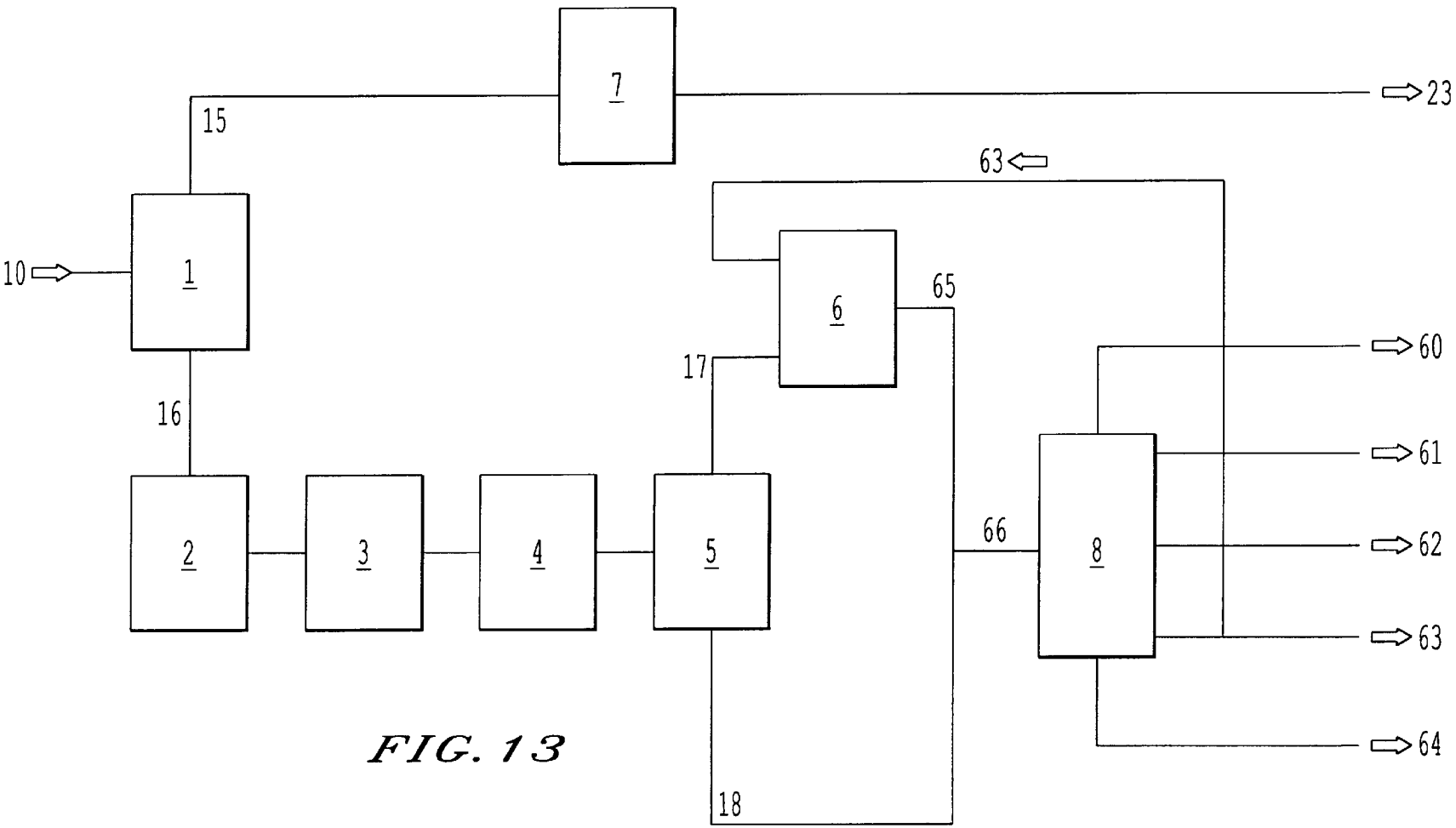
FIG. 13 is a block flowsheet of a process for treating crude oil according to the present invention (9).

FIG. 8 illustrates the block flowsheet of the embodiment for the preceding items (3) in the process for hydrogenating treating crude oil according to the present invention. In addition, the mixed reformed topped crude oil 22 as shown in FIG. 8 becomes the reformed topped crude oil in the embodiment for the preceding items (6) according to the present invention. Moreover, the mixed reformed topped crude oil 24 as shown in FIG. 9 becomes the reformed topped crude oil in the embodiment for the preceding items (8) according to the present invention, which is the mixture of hydrodesulfurized naphtha 23 obtained by subjecting the naphtha 15 which is separated in the naphtha fraction separation step 1 to hydrodesulfurization treatment 7, and the reformed topped crude oil 20.

FIG. 10 to 13 illustrate each a block flowsheet of the embodiment for the preceding items (9) in the process for hydrogenating treating a crude oil according to the present invention, and correspond to FIG. 6 to 9, respectively. The reformed crude oil, reformed topped crude oil and mixed reformed crude oil are separated, respectively in a distillation step 8, where part of the separated distillate is recycled to the hydroreforming step 6. The number of the components that are separated in the distillation step 8, which is five in these figures, is not specifically limited, but may be selected in accordance with the requirement from the product oil. It is only necessary that distillates obtained through distillation can be separated and recycled in part. It is preferable that the distillates to be recycled include kerosene and gas oil fractions. The kerosene fraction is expected to improve the smoke point of the product oil by its recycling, and gas oil fraction is expected to improve the cetane number of the product oil and further reduce sulfur contents thereof by its recycling.

In the following, some description will be given of the crude oil and each of the treatment steps.

{1} Feedstock Oil (Crude Oil)

① The term "crude oil" as mentioned herein is meant not only crude oils originating from petroleum in the strict sense of the word, but also crude oils of other origin such as liquefied coal oil, tar sand oil, oil sand oil, oil shale oil, Orinoco tar, etc. and composite oil obtainable therefrom. There is also usable a mixture of a petroleum base crude oil and a mixed oil of the above-exemplified crude oil.

② Most preferable crude oil is a petroleum base crude oil which contains at least 1% by weight of asphalten components, at least 10 ppm by weight of vanadium and nickel, respectively, or at least 0.1% by weight of sulfur components. A petroleum base crude oil failing to meet said requirement has little economical effect.

{2} Pretreatment

① It is preferable that crude oil be subjected to desalting treatment from the viewpoint of antifouling in a preliminary distillation tower and the prevention of plugging in a reactor.

② The desalting treatment method is exemplified by a chemical desalting method, an electrical desalting method by Petreco, an electrical desalting method by Hau Bayker and the like that are generally put into practice by those skilled in the art.

{3} Naphtha Fraction Separation Step (Preliminary Distillation Tower)

① It is sometimes advantageous to remove at need, a Naphtha fraction (naphtha 15) from the crude oil which has been subjected to desalting treatment, for instance, in the case where the product oil according to the present invention is subjected to atmospheric distillation in the next step to remove Naphtha fraction and subsequently to catalytic reforming. In this case, the Naphtha fraction is preferably desulfurized as low as about 0.5 ppm by weight of sulfur contents. Thus the Naphtha fraction needs to be desulfurized again, since the Naphtha fraction is difficult to desulfurize to the foregoing low level in the hydrogenation treatment in the above-mentioned embodiment (1) according to the present invention. It is preferable to remove the Naphtha fraction in the naphtha fraction separation step (preliminary distillation tower) as illustrated in FIG. 7 in the aforesaid embodiment (1) according to the present invention, and then treat otherwise the Naphtha fraction thus separated.

② In the case where the Naphtha fraction is used as a starting raw material for an ethylene production unit, there is no need to desulfurize the same as low as about 0.5 ppm by weight of sulfur contents, and accordingly the above-mentioned embodiment (1) of the process according to the present invention may be adopted for desulfurization.

③ A conventional preflash drum or a preflash column may be used to remove the Naphtha fraction (naphtha 15). Preferably, the operation temperature is in the range of 150 to 300° C., and the operation pressure is in the range of 2 to 10 kqf/cm$^2$.

④ With regard to the boiling point of the Naphtha fraction to be separated, the initial boiling point thereof is determined by the crude oil as the feedstock, and the end point is preferably in the range of 125 to 174° C. An end point thereof, when being lower than 125° C., results in lowered reaction rate due to lowered hydrogen partial pressure in the catalytic hydrogenation treatment of the next step, whereas an end point thereof, when being higher than 175° C., leads to an increase in sulfur contents of the kerosene fraction in the product oil, sometimes causing off-specification products.

{4} Hydrogenation Demetalling Step 2

① The crude oil 10 or topped crude oil 16 is raised in its temperature and pressure, and subjected to collective hydrogenation demetalling with hydrogen in the first stage hydrogenation demetalling step. This step includes one to plural reactors.

② There is used, as the catalyst for the hydrogenation demetalling step, at least one metal selected from the group consisting of metals belonging to groups 5, 6, 8, 9, and 10, respectively of the Periodic Table which is supported on a carrier comprising at least one species selected from the group consisting of porous inorganic oxides such as alumina, silica or zeolite, acidic carriers, and natural minerals, in an amount of about 3 to 30% by weight expressed in terms of oxide on the basis of the total weight of the catalyst, said catalyst having an average pore size of at least 100 Å. The catalyst may be a commercially available hydrogenation demetalling catalyst or a hydrogenation demetalling catalyst of a different type. Preferably, the necessary amount of the hydrogenation demetalling catalyst is set to 10 to 80% by volume on the basis of the cumulative amount of the metals that are contained in the crude oil to be treated during a prescribed period of time.

③ Operation conditions of the hydrogenation demetalling step include a reaction temperature in the range of 300 to 450° C., preferably 350 to 410° C., a hydrogen partial pressure in the range of 30 to 200 kgf/cm$^2$, preferably 100 to 180 kgf/cm$^2$, a hydrogen/oil ratio in the range of 200 to 2000 Nm$^3$/kl, preferably 400 to 800 Nm$^3$/kl, and an LHSV (liquid hourly space velocity) of 0.1 to 10 h$^{-1}$, preferably 0.3 to 5 h$^{-1}$. The reaction temperature, hydrogen partial pressure or hydrogen/oil ratio, when being less than said preferable range, brings about lowered reaction efficiency, whereas said factor, when being more than said preferable range, leads to lowered economical efficiency. On the contrary, the LHSV, when being more than the aforesaid preferable range, brings about lowered reaction efficiency, whereas the LHSV, when being less than the above-mentioned preferable range, leads to lowered economical efficiency.

5} Hydrocracking Step 3

① The crude oil which has been subjected to hydrogenation demetalling treatment is subsequently subjected to hydrocracking treatment in the hydrocracking step 3, wherein the fluid temperature is varied by means of a heat exchanger or the like when the reaction temperature needs to be controlled. In the case where the reaction temperature control is possible by quenching with hydrogen gas or oil, said crude oil is treated as such without installing a heat exchanger. This step includes one to plural reactors.

② As the catalyst to be used in this hydrocracking step, which is not specifically limited, there is usable at least one metal selected from the group consisting of metals belonging to groups 6, 8, 9, and 10, respectively of the Periodic Table which is supported on a carrier comprising 10 to 90% by weight of iron containing aluminosilicate and 90 to 10% by weight of an inorganic oxide, said catalyst being produced by the technique as disclosed in Japanese Patent Application Laid-Open No. 289419/1990 (Hei-2). The use of the catalyst comprising iron containing aluminosilicate which is produced by treating a steam treated steaming zeolite with an aqueous solution of an iron salt, is markedly effective in enhancing the efficiency of cracking from a fraction having a boiling range of 343° C. or higher to a fraction having a boiling range of 343° C. or lower.

There is also usable the catalyst which is produced by the technique as disclosed in Japanese Patent Application Laid-Open No.49131/1985 (Sho-60), Japanese Patent Application Laid-Open No.24433/1986 (Sho-61) and Japanese Patent Application Laid-Open No. 21484/1991 (Hei-3). Specifically, the catalyst is preferably at least one metal selected from the group consisting of metals belonging to groups 6, 8, 9, and 10, respectively of the Periodic Table which is supported on a carrier comprising 20 to 80% by weight of iron-containing aluminosilicate and 80 to 20% by weight of an inorganic oxide. The metal belonging to group 6 of the Periodic Table is preferably tungsten or molybdenum. The metal belonging to groups 7 to 10, respectively of the Periodic Table may be used alone or in combination with at least one other. Preferable combinations of the metals include Ni—Mo, Co—Mo, Ni—W and Ni—Co—Mo taking into consideration their enhanced hydrogenation activity and less deterioration.

{6} Hydrodesulfurization Step 4

① The crude oil which has been subjected to hydrogenation demetalling treatment and subsequent hydrocracking treatment, is subsequently subjected to hydrodesulfurization treatment, wherein the fluid temperature is varied with a heat exchanger or the like when the reaction temperature needs to be controlled. In the case where the reaction temperature control is possible by quenching with hydrogen gas or oil, said crude oil is treated as such without installing a heat exchanger. This step includes one to plural, reactors.

② There is used, as the catalyst for the hydrodesulfurization step 4, a conventional hydrodesulfurization catalyst for heavy oils, that is, at least one metal selected from the group consisting of metals belonging to groups 5, 6, 8, 9, and 10, respectively of the Periodic Table which is supported on a carrier comprising alumina, silica, zeolite or a mixture thereof in an amount of about 3 to 30% by weight expressed in terms of oxide on the basis of the total weight of the catalyst, said catalyst having an average pore size of at least 80 Å. There is preferably usable a catalyst for its enhanced reforming effect on kerosene and gas oil fractions, said catalyst being at least one metal selected from the group consisting of metals belonging to groups 5, 6, 8, 9, and 10, respectively of the Periodic Table, which is supported on a carrier comprising at least one member selected from the group consisting of alumina-phosphorus, alumina-alkaline earth metal compound, alumina-titania, alumina-zirconia, alumina-boria, and the like.

③ Operation conditions of the hydrodesulfurization step include a reaction temperature in the range of 300 to 450° C., preferably 350 to 420° C., a hydrogen partial pressure in the range of 30 to 200 kgf/cm$^2$, preferably 100 to 180 kgf/cm$^2$, a hydrogen/oil ratio in the range of 200 to 2000 Nm$^3$/kl, preferably 400 to 800 Nm$^3$/kl, and an LHSV (liquid hourly space velocity) of 0.1 to 10 h$^{-1}$, preferably 0.2 to 5 h$^{-1}$. The reaction temperature, hydrogen partial pressure or hydrogen/oil ratio, when being less than the above-mentioned preferable range, brings about lowered reaction efficiency, whereas said factor, when being more than the above-mentioned preferable range, gives rise to lowered economical efficiency. On the other hand, the LHSV, when being more than the above-mentioned preferable range, brings about lowered reaction efficiency, whereas the LHSV, when being less than the above-mentioned preferable range, gives rise to lowered economical efficiency.

{7} Gas-liquid Separation Step 5

① The crude oil which has been subjected to hydrogenation demetalling treatment, hydrocracking treatment and hydrodesulfurization treatment, after being controlled in the temperature to a desirable level by means of a heat exchanger, is introduced to the gas-liquid separation step 5.

There may be used in the gas-liquid separation step 5, a high temperature high pressure gas-liquid separation vessel having a structure same as that of a direct desulfurization unit for heavy oils. For the purpose of maintaining the reaction efficiency in the next stage of the hydroreforming step, it is preferable to take appropriate measures such as the selection of a gas-liquid separation vessel having a sufficiently large diameter, arrangement of a mist separator having a sufficient capacity inside the gas-liquid separation vessel and the like so as to prevent heavy oils from entering the gas-phase fluid which is separated in the high temperature high pressure gas-liquid separation vessel, which includes one to plural towers.

② Preferably, the gas-liquid separation step is performed at a pressure lower than that in the hydrodesulfurization step by 0 to 50 kgf/cm$^2$ at a temperature lower than that in the hydrodesulfurization step by 0 to 100° C.

In regard to the separation conditions in the gas-liquid separation step, when the separation pressure is made lower than the pressure at the outlet of the hydrodesulfurization step by 50 kgf/cm$^2$ or more, the reaction efficiency is lowered in the next hydroreforming step due to a decrease in hydrogen partial pressure, and besides heavy oils are more prone to mix in the gas-phase fluid to be supplied to the the next hydroreforming step. A preferable criterion in such a case is to maintain the ratio of the fraction having a boiling point of 400° C. or higher which mixes into the gas-phase fluid to at most 3% by weight based on the total amount of the gas-phase fluid. When the separation pressure is made not lower than the pressure at the outlet of the hydrodesulfurization step, there is caused an increase in the construction cost of gas-liquid separation equipment because of the necessity of a pressure boosting unit such as a compressor.

When the separation temperature is made lower than the temperature at the outlet of the hydrodesulfurization step by 100° C. or more, there are caused a decrease in the ratio of kerosene and gas oil fractions that are separated as the gas-phase fluid and a decrease in the ratio of kerosene and gas oil fractions that are supplied to the next hydroreforming step, thus failing to efficiently carry out the hydroreforming of kerosene and gas oil fractions. When the separation temperature is made higher than the temperature at the outlet of the hydrodesulfurization step, there is caused an increase in the construction cost of gas-liquid separation equipment because of the necessity of a heating unit such as a furnace.

{8} Hydroreforming Step 6

① The crude oil which has been subjected to hydrogenation demetalling treatment, hydrocracking treatment and hydrodesulfurization treatment is introduced to the gas-liquid separation step 6, where it is separated into liquid-phase fluid and gas-phase fluid, which is then subjected to hydroreforming treatment. The hydroreforming step includes one to plural reactors, where the gas-phase fluid coming from the gas-liquid separation step is subjected to hydroreforming treatment usually without any treatment such as heating or temperature raising. The gas-phase fluid temperature is varied by means of a heat exchanger or the like when the reaction temperature thereof needs to be controlled. When the reaction temperature thereof can be controlled by means of hydrogen gas or a recycling oil, the gas-phase fluid is subjected to hydroreforming treatment as such. As the type of the reactor in this step, an ordinary fixed-bed reactor may be used.

② There is used, as the catalyst for the hydroreforming step 6, a conventional hydrogenation catalyst for intermediate fractions, that is, at least one metal selected from the group consisting of metals belonging to groups 5, 6, 8, 9, and 10, respectively of the Periodic Table which is supported on a carrier comprising alumina, silica, zeolite or a mixture thereof, in an amount of about 3 to 30% by weight expressed in terms of oxide on the basis of the total weight of the catalyst, said catalyst having an average pore size of at least 80 Å. There is preferably usable a catalyst for its enhanced hydrorefoming effect on kerosene and gas oil fractions, said catalyst being at least one metal selected from the group consisting of metals belonging to groups 5, 6, 8, 9, and 10, respectively of the Periodic Table, which is supported on a carrier comprising at least one member selected from the group consisting of alumina-phosphorus, alumina-alkaline earth metal compound, alumina-titania, alumina-zirconia, alumina-boria, and the like.

③ As the operation conditions of the hydroreforming step, the reaction temperature and reaction pressure are each almost the same as the separation temperature and separation pressure, respectively for the above-described gas-liquid separation step, since the hydroreforming reaction is carried out subsequent to said gas-liquid separation step without the use of any unit for heating or temperature raising. Preferably, the reaction temperature is in the range of 300 to 400° C., and the reaction pressure is in the range of 100 to 180 kgf/cm$^2$G. In order to make effective use of the temperature and pressure at the outlet of the hydrodesulfurization step as the preceding stage for the hydroreforming step as the subsequent stage, it is preferable to set the reaction temperature to a temperature lower than the temperature at the outlet of the hydrodesulfurization step by 0 to 100° C., and set the reaction pressure to a pressure lower than the pressure at the outlet of the hydrodesulfurization step by 0 to 50 kgf/cm$^2$. In addition, it is preferable to set a hydrogen partial pressure in the range of 70 to 150 kgf/cm$^2$G, a hydrogen/oil ratio in the range of 500 to 2000 Nm$^3$/kl, and an LHSV (liquid hourly space velocity) in the range of 0.5 to 10 h$^{-1}$. The reaction temperature, hydrogen partial pressure or hydrogen/oil ratio, when being less than the above-mentioned preferable range, brings about lowered reaction efficiency, whereas said factor, when being more than the above-mentioned preferable range, leads to lowered economical efficiency. On the contrary, the LHSV, when being more than the aforesaid preferable range, brings about lowered reaction efficiency, whereas the LHSV, when being less than the above-mentioned preferable range, leads to lowered economical efficiency.

{9} Separation of Impurities and the Like

The fluid which has been subjected to hydrogenation demetalling treatment, hydrocracking treatment, hydrodesulfurization treatment, gas-liquid separation and hydroreforming treatment, is introduced in accordance with a conventional method into a separation step along with the liquid-phase fluid which has been separated in the gas-liquid separation step, where the fluids are separated into a gas portion and a liquid portion. Such impurities as hydrogen sulfide, ammonia and the like are removed from the gas portion thus separated, and then the gas portion thus treated is subjected to a hydrogen purification treatment, joined with a fresh feed gas, and thereafter recycled through the reaction system.

{10} Naphtha Fraction Remixing Step

In the case where Naphtha fraction (naphtha 15) is removed from the crude oil in the foregoing {3} Naphtha fraction separation step, the Naphtha fraction can be treated by any of the following methods ① to ④ according to the demand of the products.

① The Naphtha fraction is collected to make it a product as such (refer to FIG. 7).

② The Naphtha fraction is mixed with the liquid portion obtained in the foregoing {9} Separation of impurities and the like to make it a mixed reformed crude oil.

③ The Naphtha fraction is pressurized and heated, and then introduced to the foregoing {8} Hydroreforming step (refer to FIG. 8).

④ The Naphtha fraction is subjected to hydrodesulfurization treatment 7, and is mixed with the liquid portion obtained in the foregoing {9} Separation of impurities and the like to make the mixture a mixed reformed crude petroleum (refer to FIG. 9).

{11} Production of Reformed Crude Oil

Depending upon the locational conditions for the commercialization of the process according to the present invention, it is sometimes advantageous that the liquid portion obtained in any of the methods in the foregoing {9} Separation of impurities and the like, is mixed with the Naphtha fraction by any of the methods in the foregoing {10}, and thereafter the resultant mixture is shipped as a reformed crude oil. The foregoing applies to the case where a hydrogenation treatment plant concerning the present invention is located in the vicinity of a crude oil shipping unit in an oil producing country and at a place where the crude oil shipping unit is completed, but an oil product shipping unit is unavailable. In this case, the crude oil produced therein is usable as such, or it is fed to a hydrogen sulfide removal unit attached to desulfurization equipment, for instance, a hydrogen sulfide stripper so that it is made possible to obtain a reformed crude oil, reformed topped crude oil or mixed reformed crude oil, each of them being freed from hydrogen sulfide. By converting the crude oil produced therein to the reformed crude oil, mention is made of such effect and advantage that the existing crude oil shipping unit is usable as it is, and besides each of the reformed crude oil can be transported at a low cost by using large-sized oil tankers.

{12} Distillation Separation Step

In addition to the reformed crude oil in the foregoing {11}, the liquid portion obtained in the separation step of the foregoing {9}, or any of the mixed crude oil, reformed crude oil, reformed topped crude oil and mixed reformed crude oil is fed to a distillation separation step, and fractionated into each oil product by a conventional process. It is possible to fractionate the feedstock into naphtha, kerosene, gas oil and atmospheric residue under the atmospheric fractionation conditions by setting the boiling range of naphtha fraction on 20 to 157° C., that of kerosene fraction on 157 to 239° C., that of gas oil fraction on 239 to 343° C., and atmospheric residue on 343° C. and higher. The atmospheric residue may be consecutively distilled under vacuum into vacuum kerosene and vacuum gas oil.

{13} Recycling Treatment for Distillates

It is possible to recycle and treat the distillates (preferably part of the gas oil fraction in 5 to 95% by volume) which is obtained in the distillation separation step in the the foregoing {12} to the hydroreforming step as shown in the the foregoing {8} through heating and pressurizing.

As the working effect arising out of the aforesaid procedure, it is made possible to obtain particularly high-quality gas oil fraction, which is capable of coping with the prospective intensified regulation on the quality of gas oil without installing a new reactor. It is also made possible to modify the quality of the gas oil into desirable quality by altering the recycling ratio and the characteristics of recycled fractions (refer to FIG. 10 to FIG. 13).

{14} Type of Reactor

There is no specific limitation on the type of the reaction equipment in hydrogenation demetalling treatment, hydrocracking treatment and hydrodesulfurization treatment in the process according to the present invention, thus enabling to adopt, for example, reaction equipment of fixed bed type, moving bed type, fluidized bed type, ebullient bed type, slurry bed type and the like. The reaction equipment in gas-phase hydroreforming treatment, although not specifically limited on the type thereof, is preferably of a low-cost fixed bed type because of its gas-phase reaction. It is also possible to employ only one reactor for two or more treatment steps among the hydrogenation demetalling treatment, hydrocracking treatment and hydrodesulfurization treatment.

The effects and advantages of the present invention are summarized as follows.

(1) The process according to the present invention markedly improves the qualities of the kerosene and gas oil fractions in the product oils that are obtained by subjecting crude oil or crude oil from which Naphtha fraction has been removed to hydrogenation demetalling treatment, hydrocracking treatment, hydrodesulfurization treatment and then gas-liquid separation, and hydroreforming the resultant gas-phase fluid. There is sufficient likelihood by the improvement mentioned above that the kerosene fraction can clear the regulation on jet fuels and that it is enabled to produce the gas oil fraction which can clear the European regulation in A.D. 2005 on sulfur contents.

(2) In addition to the utilization for the improvement on the conventional oil refinery process, the process of the present invention is applicable to the purpose of use for reforming heavy crude oil of a high sulfur content into a light crude oil of a low sulfur content in oil refinery units located in oil producing countries.

Said purpose of use brings about the following effects.

(a) Increase in liquid yield of reformed crude oil by cracking crude oil as the feedstock.

(b) The kerosene and gas oil produced by the present process being much superior in quality to the kerosene and gas oil produced from conventional light crude oil of a low sulfur content.

(c) Capability of handling crude oil in the same manner as in conventional crude oil, using existing oil shipping facilities and also capability of transporting large amounts of respective oils at low costs by means of large sized oil tankers.

In the following, the present invention will be described in more detail with reference to comparative examples and working examples, which however shall not limit the present invention thereto.

There were used as feed crude oil, Arabian heavy desalted crude oil, naphtha fraction therefrom, Arabian heavy desalted crude oil from which light fractions have been removed (hereinafter referred to as "Arabian heavy topped crude oil"). The characteristics of the feed crude oil are given in Table 1. The characteristics of the catalysts that were used for the reaction of each of the treatment steps are given in Table 2.

TABLE 1

Characteristics of Feed Crude Oil

| Item | Arabian heavy desalted crude oil | Arabian heavy desalted crude oil from which naphtha fraction has been removed | Naphtha fraction removed therefrom |
|---|---|---|---|
| Density (g/ml at 15° C.) [JIS K2249] | 0.8922 | 0.9238 | 0.7004 |
| Sulfur content (wt %) [JIS K2541] | 2.84 | 3.19 | 0.026 |
| Nitrogen content (wt ppm) [JIS K2609] | 1460 | 1640 | 1> |
| V content (wt ppm) [JPI 5S-10] | 53.6 | 56.5 | — |
| Ni content (wt ppm) [JPI 55-11] | 17.1 | 17.9 | — |
| n-Heptane-insoluble portion (wt %) | 4.59 | 5.11 | — |
| Distillation characteristics [Naphtha: ASTM D3710] [Others: ASTM D5307] | | | |
| IBP: ° C. | 1 | 101 | 22 |
| 50% distilled | 423 | 450 | 92 |
| EP: ° C. | — | — | 174 |
| Yield (vol % based on crude petroleum) | 100 | 85.8 | 14.2 |

TABLE 2

Characteristics of Catalyst

| Catalyst | Hydrogenation demetalling catalyst A | Hydrocracking catalyst B | Hydrodesulfurization catalyst C | Hydroreforming catalyst D |
|---|---|---|---|---|
| Carrier | | | | |
| Composition (wt % based on carrier) | | | | |
| Alumina | 100 | 35 | 90 | 90 |
| Boria | | | 10 | 10 |
| Iron-containing aluminosilicate | | 65 | | |
| Catalyst | | | | |
| Composition (wt % based on catalyst) | | | | |
| Nickel oxide | 2.3 | | | 7 |
| Molybdenum oxide | 8.3 | 10.0 | 14.0 | |
| Cobalt oxide | | 4.0 | 3.7 | |
| Tungsten oxide | | | | 22.4 |
| Specific surface area [$m^2/g$] | 143 | 445 | 228 | 228 |
| Pore volume [ml/g] | 0.76 | 0.62 | 0.71 | 0.71 |
| Average pore size [Å] | 190 | 158 | 124 | 124 |

[Remarks] In Catalyst B, iron-containing steaming zeolite was prepared as per Example 1 of Jap.Pat.Laid-Open No.289419/1990 and in Catalyst C&D, alumina-boria carrier was prepared as per Example 1 of Jap.Pat.Laid-Open No.319994/1994.

EXAMPLE 1

(1) Hydrogenation Demetalling Treatment, Hydrocracking Treatment and Hydrodesulfurization Treatment Reactions for these treatments were carried out by packing 28% by volume of the catalyst A, 33% by volume of the catalyst B and 39% by volume of the catalyst C in this order in series into a 300 ml tubular reactor.

Arabian heavy desalted crude oil as feed crude oil as shown in Table 1 was subjected to said treatment steps under the conditions including a hydrogen partial pressure of 135 $kgf/cm^2G$, a hydrogen/oil ratio of 550 $Nm^3/kl$, a reaction temperature of 380° C. for the catalyst A, 400° C. for the catalyst B and 360° C. for the catalyst C, and an LHSV of 0.408 $h^{-1}$ based on the whole volume of the catalysts.

(2) Gas-liquid Separation Step and Hydroreforming Step

The product oil A which had been produced during the reaction (1) for 1000 to 3000 hours from the start of the reaction, was separated into each of fractions including naphtha, kerosene and vacuum gas oil by the use of a batchwise distillation apparatus. Thus there was prepared feed oil for hydroreforming (hereinafter referred to as "gas-phase fluid A") having chemical composition same as that of the gas-phase fluid in the high temperature high pressure gas-liquid separator on the basis of the result of calculation for gas-phase composition at 340° C. and a total pressure of 135 $kgf/cm^2A$ by means of adiabatic calculation for continuous gas-liquid separation through the use of a process simulator (produced by SimSci Corp. under the trade name "PRO/II Ver.5). The chemical composition of the gas-phase fluid A is given in Table 3-1.

TABLE 3-1

Properties of feed oil for hydroreforming

| Item | Feed oil for hydroreforming |
|---|---|
| Density (g/ml at 15° C.) [JIS K2249] | 0.7862 |
| Sulfur content (wt %) [JIS K2541] | 400 |
| Smoke point (mm) [JIS K2537] | 21.0 |
| Monocyclic aromatic compound (% by vol.) | 19.5 |
| Bicyclic aromatic compound (% by vol.) | 0.2 |
| Tricyclic aromatic compound (% by vol.) | 0.1> |
| Total aromatic compound (% by vol.) {above 4 items according to JPI 5S-49-97} | 19.7 |
| Naphtha fraction (% by weight) | 52.3 |
| Kerosene fraction (% by weight) | 37.4 |
| Gas oil fraction (% by weight) | 8.6 |
| Vacuum gas oil fraction (% by weight) | 1.7 |

Hydroreforming reaction was carried out for the gas-phase fluid A by packing the catalyst D as shown in Table 2 into a 30 ml tubular reactor under the conditions including a hydrogen partial pressure of 105 kgf/cm$^2$G, a hydrogen/oil ratio of 700 Nm$^3$/kl, a reaction temperature of 340° C. and an LHSV of 3.0 h$^{-1}$.

A mixture was prepared as the product oil C (reformed crude oil) by mixing the product oil B which was produced by hydroreforming reaction during the feeding time of 1500 to 2000 hours from the start of the reaction, and the residual oil (liquid-phase fluid) which was separated corresponding to the gas-phase fluid A used during said hours at the proportion of the gas-phase fluid A which was separated in the gas-liquid separation to the liquid-phase fluid corresponding to the gas-phase fluid A.

The resultant product oil C was separated through distillation by the use of distillation equipment having 15 theoretical plate column, into LPG (propane and butane), naphtha fraction (pentane to 157° C. B.P.), kerosene fraction (157 to 239° C. B.P.), gas oil fraction (239 to 343° C. B.P.) and atmospheric residue (fraction of over 343° C. B.P.). Thus analysis was made for the qualities of each of the fractions. The yield and properties of each of the fractions are given in Table 4.

Moreover, the atmospheric residue was separated into vacuum gas oil (343 to 525° C. B.P.) by means of vacuum simple distillation. The yield and properties of the vacuum gas oil are given in Tables 4-1, 4-2, and 4-3.

As the results, there were obtained kerosene and gas oil fractions which had high qualities minimized in the contents of sulfur components, aromatic components and polycyclic aromatic components. In addition, the liquid fractions had each a lowered density and an increased volume by about 7%, since the Arabian heavy crude oil as the feedstock was hydrocracked.

EXAMPLE 2

(1) Hydrogenation Demetalling Treatment, Hydrocracking Treatment and Hydrodesulfurization Treatment The procedure in Example 1 was repeated to proceed with the reactions for these treatments by the use of the catalysts same as in Example 1 except that the tubular reactor was charged with, as feed crude oil, Arabian heavy desalted crude oil from which naphtha fraction and the fraction more light than the naphtha fraction (hereinafter collectively referred to as "Naphtha fraction") had been removed (hereinafter referred to as "Arabian heavy topped crude oil") as indicated in Table 1, at an LHSV of 0.35 h$^{-1}$, which however was the same as the LHSV in Example 1, when expressed in terms of the LHSV based on Arabian heavy topped crude oil instead of Arabian heavy desalted crude oil.

(2) Gas-liquid Separation Step and Hydroreforming Step

The procedure in Example 1 was repeated to carry out gas-liquid separation, hydroreforming reaction, mixing of the gas-phase fluid and the liquid-phase fluid that were hydroreformed and separation of the product oil by distillation. The chemical composition of the feed oil for hydroreforming (gas-phase fluid) is given in Table 3-2. The yield and properties of each of the product oil are given in Tables 4-1, 4-2, and 4-3, wherein the yields were based on the Arabian heavy desalted crude oil.

TABLE 3-2

Properties of feed oil for hydroreforming

| Item | Feed oil for hydroreforming |
|---|---|
| Density (g/ml at 15° C.) [JIS K2249] | 0.7942 |
| Sulfur content (wt %) [JIS K2541] | 450 |
| Smoke point (mm) [JIS K2537] | 22.0 |
| Monocyclic aromatic compound (% by vol.) | 19.9 |
| Bicyclic aromatic compound (% by vol.) | 0.2 |
| Tricyclic aromatic compound (% by vol.) | 0.1> |
| Total aromatic compound (% by vol.) {above 4 items according to JPI 5S-49-97} | 20.1 |
| Naphtha fraction (% by weight) | 48.2 |
| Kerosene fraction (% by weight) | 36.4 |
| Gas oil fraction (% by weight) | 13.7 |
| Vacuum gas oil fraction (% by weight) | 1.7 |

As is the case with Example 1, there were obtained kerosene and gas oil fractions which had high qualities minimized in the contents of sulfur components, aromatic components and polycyclic aromatic components.

EXAMPLE 3

(1) Hydrogenation Demetalling Treatment, Hydrocracking Treatment and Hydrodesulfurization Treatment The procedure exactly the same as that in Example 2-(1) was repeated to proceed with these treatment reactions.

(2) Gas-liquid Separation Step and Hydroreforming Step

The procedure exactly the same as that in Example 2-(2) was repeated to proceed with the treatment and reaction.

(3) Mixing of Naphtha Fraction

To the product oil C which had been obtained in the preceding item (2) was added the Naphtha fraction (the properties being given in Table 1) which had been separated at the time of preparing the Arabian heavy topped crude oil from the Arabian heavy crude oil to obtain reformed crude oil. The resultant reformed crude oil was separated through distillation by the use of distillation equipment having 15 theoretical plate column in the same manner as in Example 2-(2), into LPG (propane and butane), naphtha fraction (pentane to 157° C. B.P.), kerosene fraction (157 to 239° C. B.P.), gas oil fraction (239 to 343° C. B.P.) and atmospheric residue (fraction of over 343° C. B.P.). Thus analysis was made for the qualities of each of the fractions. The yield and properties of each of the fractions are given in Table 4-1, 4-2 and 4-3.

As the results, there were obtained kerosene and gas oil fractions having high qualities minimized in the contents of sulfur components, aromatic components and polycyclic aromatic components. Moreover, the liquid fractions had each a lowered density and an increased volume by about 7% as compared with the Arabian heavy crude oil as the initial feedstock.

EXAMPLE 4

(1) Hydrogenation Demetalling Treatment, Hydrocracking Treatment and Hydrodesulfurization Treatment The procedure exactly the same as that in Example 3-(1) was repeated to proceed with these treatment reactions.

(2) Gas-liquid Separation Step and Hydroreforming Step

The procedure exactly the same as that in Example 3-(2) was repeated to proceed with the treatment and reaction.

(3) Hydrodesulfurization of Naphtha Fraction

Hydrodesulfurization reaction was carried out for the Naphtha fraction which had been withdrawn out at the time of preparing the Arabian heavy topped crude oil as shown in Table 1 as the feed oil by packing the catalyst C as shown in Table 2 into a 30 ml tubular reactor under the reaction conditions including a hydrogen partial pressure of 15 $kgf/cm^2G$, a hydrogen/oil ratio of 100 $Nm^3/kl$, a reaction temperature of 320° C. and an LHSV of 7.5 $h^{-1}$ to produce hydrodesulfurized Naphtha fraction.

(4) Mixing of Hydrodesulfurized Naphtha Fraction

The hydrodesulfurized Naphtha fraction obtained in the preceding item (3) was incorporated into the product oil C after the hydroreforming treatment in the same manner as in Example 3 to produce mixed reformed crude oil. The resultant mixed reformed crude oil was separated through distillation by the use of distillation equipment having 15 theoretical plate column in the same manner as in Example 2-(2), into LPG (propane and butane), naphtha fraction (pentane to 157° C. B.P.), kerosene fraction (157 to 239° C. B.P.), gas oil fraction (239 to 343° C. B.P.) and atmospheric residue (fraction of over 343° C. B.P.). Thus analysis was made for the qualities of each of the fractions. The yield and properties of each of the fractions are given in Tables 4-1, 4-2 and 4-3. It can be seen from said Tables that the sulfur content of the Naphtha fraction, which was further decreased as compared with that in Example 3, was lowered to the extent that said Naphtha fraction was acceptable as a feedstock for catalytic naphtha reformers.

EXAMPLE 5

(1) Hydrogenation Demetalling Treatment, Hydrocracking Treatment and Hydrodesulfurization Treatment The procedure exactly the same as that in Example 3-(1) was repeated to proceed with these treatment reactions.

(2) Gas-liquid Separation Step and Hydroreforming Step

A hydroreforming treatment was carried out in the same manner as in Example 1 except that there was used as the feedstock, the mixture of the hydroreformed crude oil (gas-phase fluid) as shown in Table 5 and 40% by volume of the Naphtha fraction which had been withdrawn out at the time of preparing the Arabian heavy topped crude oil. Subsequently in the same manner as in Example 3, there was obtained the product oil C (mixed reformed crude oil). The resultant mixed reformed crude oil was separated through distillation by the use of distillation equipment having 15 theoretical plate column in the same manner as in Example 2-(2), into LPG (propane and butane), naphtha fraction (pentane to 157° C. B.P.), kerosene fraction (157 to 239° C. B.P.), gas oil fraction (239 to 343° C. B.P.) and atmospheric residue (fraction of over 343° C. B.P.). Thus analysis was made for the qualities of each of the fractions. The yield and properties of each of the fractions are given in Table 4-1, 4-2 and 4-3. It can be seen from said Tables that the sulfur content of the resultant Naphtha fraction, which was further decreased as was the case with Example 4, was lowered to the extent that the Naphtha fraction was acceptable as a feedstock for catalytic naphtha reformers.

EXAMPLE 6

(1) Hydrogenation Demetalling Treatment, Hydrocracking Treatment and Hydrodesulfurization Treatment The procedure exactly the same as that in Example 2-(1) was repeated to proceed with these treatment reactions.

(2) Gas-liquid Separation Step Incorporated with the Recycling Treatment of Gas Oil Fraction, and Hydroreforming Step A hydroreforming treatment was carried out in the same manner as in Example 3 except that there was used as the feedstock, the mixture of the hydroreformed crude oil (gas-phase fluid) as shown in Table 5 and 50% by weight of the gas oil fraction as shown in Table 4 of Example 3.

Thereafter in the same manner as in Example 3, there was obtained the product oil C (reformed naphtha-stripped crude oil). The resultant mixed reformed crude oil was separated through distillation by the use of distillation equipment having 15 theoretical plate column in the same manner as in Example 2-(2), into LPG (propane and butane), naphtha fraction (pentane to 157° C. B.P.), kerosene fraction (157 to 239° C. B.P.), gas oil fraction (239 to 343° C. B.P.) and atmospheric residue (fraction of over 343° C. B.P.). Thus analysis was made for the qualities of each of the fractions. The yield and properties of each of the fractions are given in Table 4-1, 4-2 and 4-3.

It can be seen from said Tables that there was obtained an extremely clean and high-quality gas oil fraction which had further decreased contents of sulfur components, aromatic components and polycyclic aromatic components as compared with Example 3. Moreover, it is easily expected that the quality modification of the gas oil fraction is made possible by altering the recycling ratio.

TABLE 4-1

Yield and Properties of each Fraction

| Item | Yield vs. feedstock (vol. %) | Density (g/ml) | Sulfur content (wt. ppm) | Nitrogen content (wt. ppm) |
|---|---|---|---|---|
| {Example 1} | | | | |
| LPG | 3.8 | 0.5568 | — | — |
| Naphtha | 37.1 | 0.7275 | 1 | 1> |
| Kerosene fraction | 19.9 | 0.7957 | 3 | 1> |
| Gas oil fraction | 12.9 | 0.8158 | 90 | 6 |
| Atmospheric residue | 33.3 | 0.9583 | 18000 | 2520 |
| Vacuum gas oil fraction | (16.7) | 0.8892 | 6100 | 610 |
| Total fractions | 107.0 | 0.8104 | 7500 | 1050 |
| {Example 2} | | | | |
| LPG | 3.0 | 0.5576 | — | — |
| Naphtha | 19.5 | 0.7295 | 1 | 1> |
| Kerosene fraction | 21.2 | 0.7945 | 2 | 1> |
| Gas oil fraction | 15.1 | 0.8119 | 60 | 3 |
| Atmospheric residue | 33.2 | 0.9634 | 18400 | 2470 |
| Vacuum gas oil fraction | (14.7) | 0.8809 | 5800 | 450 |
| Total fractions | 92.2 | 0.8524 | 6900 | 1180 |
| {Example 3} | | | | |
| LPG | 3.5 | 0.5566 | — | — |
| Naphtha | 33.5 | 0.7160 | 46 | 1> |
| Kerosene fraction | 21.4 | 0.7935 | 8 | 1> |
| Gas oil fraction | 15.1 | 0.8119 | 60 | 3 |
| Atmospheric residue | 33.2 | 0.9634 | 18400 | 2470 |
| Total fractions | 106.7 | 0.8193 | 6900 | 1180 |
| {Example 4} | | | | |
| LPG | 3.5 | 0.5566 | — | — |
| Naphtha | 33.5 | 0.7156 | 0.5 | 1> |
| Kerosene fraction | 21.4 | 0.7941 | 8 | 1> |
| Gas oil fraction | 15.1 | 0.8119 | 60 | 3 |

TABLE 4-1-continued

Yield and Properties of each Fraction

| Item | Yield vs. feedstock (vol. %) | Density (g/ml) | Sulfur content (wt. ppm) | Nitrogen content (wt. ppm) |
|---|---|---|---|---|
| Atmospheric residue | 33.2 | 0.9634 | 18400 | 2470 |
| Total fractions | 106.7 | 0.8193 | 6900 | 1180 |
| {Example 5} | | | | |
| LPG | 3.5 | 0.5566 | — | — |
| Naphtha | 33.5 | 0.7166 | 0.4 | 1> |
| Kerosene fraction | 21.4 | 0.7935 | 10 | 1> |
| Gas oil fraction | 15.1 | 0.8120 | 60 | 4 |
| Atmospheric residue | 33.2 | 0.9634 | 18400 | 2470 |
| Total fractions | 106.7 | 0.8193 | 6900 | 1180 |
| {Example 6} | | | | |
| LPG | 3.5 | 0.5558 | — | — |
| Naphtha | 33.6 | 0.7160 | 46 | 1> |
| Kerosene fraction | 21.4 | 0.7935 | 9 | 1> |
| Gas oil fraction | 15.0 | 0.8106 | 35 | 2 |
| Atmospheric residue | 33.2 | 0.9634 | 18400 | 2470 |
| Total fractions | 106.7 | 0.8193 | 6900 | 1180 |

TABLE 4-2/4-3

Properties of each Fraction

| Item | A vol % | B vol % | C | D mm | E wt % | F wt ppm | G wt ppm | H wt % |
|---|---|---|---|---|---|---|---|---|
| {Example 1} | | | | | | | | |
| LPG | — | — | — | — | — | — | — | — |
| Naphtha | 11.9 | — | — | — | — | — | — | — |
| Kerosene fraction | 9.5 | 0.1 | — | 26.5 | — | — | — | — |
| Gas oil fraction | 10.1 | 1.9 | 69.9 | — | — | — | — | — |
| Atmospheric residue | — | — | — | — | 2.90 | 22 | 14 | 12.8 |
| Vacuum gas oil fraction | — | — | — | — | — | — | — | — |
| Total fractions | — | — | — | — | 1.21 | 9.2 | 5.8 | — |
| {Example 2} | | | | | | | | |
| LPG | — | — | — | — | — | — | — | — |
| Naphtha | 11.8 | — | — | — | — | — | — | — |
| Kerosene fraction | 9.8 | 0.2 | — | 28.0 | — | — | — | — |
| Gas oil fraction | 7.4 | 1.5 | 73.5 | — | — | — | — | — |
| Atmospheric residue | — | — | — | — | 2.91 | 23 | 13 | 12.6 |
| Vacuum gas oil fraction | — | — | — | — | — | — | — | — |
| Total fractions | — | — | — | — | 1.25 | 9.5 | 5.4 | — |
| {Example 3} | | | | | | | | |
| LPG | — | — | — | — | — | — | — | — |
| Naphtha | 13.4 | — | — | — | — | — | — | — |
| Kerosene fraction | 10.3 | 0.2 | — | 28.5 | — | — | — | — |
| Gas oil fraction | 7.4 | 1.5 | 73.3 | — | — | — | — | — |
| Atmospheric residue | — | — | — | — | 2.91 | 23 | 13 | 12.6 |
| Total fractions | — | — | — | — | 1.25 | 9.5 | 5.4 | — |
| {Example 4} | | | | | | | | |
| LPG | — | — | — | — | — | — | — | — |
| Naphtha | 13.0 | — | — | — | — | — | — | — |
| Kerosene fraction | 10.3 | 0.2 | — | 28.5 | — | — | — | — |
| Gas oil fraction | 7.4 | 1.6 | 73.6 | — | — | — | — | — |

TABLE 4-2/4-3-continued

Properties of each Fraction

| Item | A vol % | B vol % | C | D mm | E wt % | F wt ppm | G wt ppm | H wt % |
|---|---|---|---|---|---|---|---|---|
| Atmospheric residue | — | — | — | — | 2.91 | 23 | 13 | 12.6 |
| Total fractions | — | — | — | — | 1.25 | 9.5 | 5.4 | — |
| {Example 5} | | | | | | | | |
| LPG | — | — | — | — | — | — | — | — |
| Naphtha | 12.0 | — | — | — | — | — | — | — |
| Kerosene fraction | 10.5 | 0.3 | — | 28.0 | — | — | — | — |
| Gas oil fraction | 7.5 | 1.5 | 73.5 | — | — | — | — | — |
| Atmospheric residue | — | — | — | — | 2.91 | 23 | 13 | 12.6 |
| Total fractions | — | — | — | — | 1.25 | 9.5 | 5.4 | — |
| {Example 6} | | | | | | | | |
| LPG | — | — | — | — | — | — | — | — |
| Naphtha | 13.4 | — | — | — | — | — | — | — |
| Kerosene fraction | 10.5 | 0.2 | — | 28.0 | — | — | — | — |
| Gas oil fraction | 5.2 | 0.9 | 74.2 | — | — | — | — | — |
| Atmospheric residue | — | — | — | — | 2.91 | 23 | 13 | 12.6 |
| Total fractions | — | — | — | — | 1.25 | 9.5 | 5.4 | — |

{Remarks}: A; total aromatic component, B; polycyclic aromatic component, C; Cetane Index, D; smoke point, E; pentane-insoluble portion, F; vanadium component, G; nickel component, H; carbon residue content.

Comparative Example 1

(1) Hydrogenation Demetalling Treatment and Hydrodesulfurization Treatment of Crude Oil Reactions for these treatments were carried out by packing 41.8% by volume of the catalyst A and 58.2% by volume of the catalyst C (excluding the catalyst B) in this order in series into a 300 ml tubular reactor by the use of the feed crude oil same as in Example 1 under the reaction conditions same as in Example 1. The product oil thus obtained was separated through distillation by the use of distillation equipment having 15 theoretical plate column, into LPG (propane and butane), naphtha fraction (pentane to 157° C. B.P.), kerosene fraction (157 to 239° C. B.P.), gas oil fraction (239 to 343° C. B.P.) and atmospheric residue (fraction of over 343° C. B.P.). Thus analysis was made for the qualities of each of the fractions. The yield and properties of each of the fractions are given in Table 4.

Moreover, the atmospheric residue was separated into vacuum gas oil (343 to 525° C. B.P.) by means of vacuum simple distillation. The yield and properties of the vacuum gas oil are given in Tables 4-4, 4-5, and 4-6.

As the results, there were obtained kerosene and gas oil fractions which were inferior to those in Example 1 because of higher contents of sulfur components, aromatic components and polycyclic aromatic components. In addition, an increase in liquid volume was less than that in Example 1.

Comparative Example 2

(1) Hydrogenation Demetalling Treatment and Hydrodesulfurization Treatment of Stripped Crude Oil The procedure in Comparative Example 1 was repeated to proceed with the reactions for these treatments except that the Arabian heavy topped crude oil was treated instead of the Arabian heavy crude oil, and the LHSV was set to 0.35 $h^{-1}$ instead of 0.408 $h^{-1}$ in order to equalize the LHSV based on the Arabian heavy topped crude oil with that based on the Arabian heavy crude oil. The yield and properties of each of the product oils are given in Tables 4-4, 4-5, and 4-6, wherein the yield was based on the Arabian heavy crude oil.

As the results, there were obtained kerosene and gas oil fractions which were inferior to those in Example 2 because of higher contents of sulfur components, aromatic components and polycyclic aromatic components. In addition, an increase in liquid volume was less than that in Example 2.

Comparative Example 3

Hydrogenation Demetalling Treatment, Hydrocracking Treatment and Hydrodesulfurization Treatment of Stripped Crude Oil The procedure exactly the same as that in Example 2-(1) was repeated to proceed with these treatment reactions.

The resultant reformed crude oil was separated through distillation to obtain each of the fractions. The yield and properties of each of the fractions are given in Tables 4-4, 4-5 and 4-6.

As the results, there were obtained kerosene and gas oil fractions which were inferior to those in Example 2 because of higher contents of sulfur components, aromatic components and polycyclic aromatic components.

Comparative Example 4

Fractionation was carried out in the same manner as in Examples 3 to 6 except that there was used Marbun crude oil having a sulfur content and density that were almost the same as those of the product oils in Examples 3 to 6. The yield and properties of each of the fractions are given in Tables 4-4, 4-5 and 4-6.

As the results, there were obtained kerosene, gas oil and vacuum gas oil fractions which were interior to those in Examples 3 to 6, since the sulfur contents of the kerosene, gas oil and vacuum gas oil fractions were higher than those in Examples 3 to 6, and the aromatic components of the kerosene and gas oil fractions were higher than those in Examples 3 to 6, though the total sulfur contents of both the oils were almost the same.

TABLE 4-4

Yield and Properties of each Fraction

| Item | Yield vs. feedstock (vol. %) | Density (g/ml) | Sulfur content (wt. ppm) | Nitrogen content (wt. ppm) |
|---|---|---|---|---|
| {Comp. Example 1} | | | | |
| LPG | 3.5 | 0.5538 | — | — |
| Naphtha | 17.7 | 0.7282 | 15 | 1 |
| Kerosene fraction | 15.1 | 0.7958 | 13 | 5 |
| Gas oil fraction | 18.1 | 0.8363 | 200 | 79 |
| Atmospheric residue | 47.1 | 0.9308 | 15000 | 2250 |
| Vacuum gas oil fraction | (20.0) | 0.8792 | 5100 | 540 |
| Total fractions | 101.5 | 0.8662 | 9500 | 1425 |
| {Comp. Example 2} | | | | |
| LPG | 3.8 | 0.5577 | — | — |
| Naphtha | 2.0 | 0.7500 | 94 | 5 |
| Kerosene fraction | 16.4 | 0.8052 | 15 | 17 |
| Gas oil fraction | 18.3 | 0.8383 | 220 | 78 |
| Atmospheric residue | 45.5 | 0.9289 | 18400 | 2310 |
| Vacuum gas oil fraction | (19.5) | 0.8609 | 5800 | 350 |
| Total fractions | 86.0 | 0.8630 | 6900 | 980 |
| {Comp. Example 3} | | | | |
| LPG | 3.0 | 0.5576 | — | — |
| Naphtha | 19.5 | 0.7419 | 19 | 1> |
| Kerosene fraction | 21.2 | 0.8025 | 5 | 2 |

TABLE 4-4-continued

Yield and Properties of each Fraction

| Item | Yield vs. feedstock (vol. %) | Density (g/ml) | Sulfur content (wt. ppm) | Nitrogen content (wt. ppm) |
|---|---|---|---|---|
| Gas oil fraction | 15.1 | 0.8192 | 130 | 31 |
| Atmospheric residue | 33.2 | 0.9634 | 18400 | 2470 |
| Vacuum gas oil fraction | (14.7) | 0.8809 | 5800 | 450 |
| Total fractions | 92.0 | 0.8622 | 6900 | 1180 |
| {Comp. Example 4} | | | | |
| LPG | 1.9 | 0.5577 | — | — |
| Naphtha | 25.0 | 0.7120 | 17 | — |
| Kerosene fraction | 17.2 | 0.7939 | 54 | 1> |
| Gas oil fraction | 19.1 | 0.8428 | 7200 | 45 |
| Atmospheric residue | 36.8 | 0.9188 | 14300 | 1020 |
| Vacuum gas oil fraction | (25.0) | 0.9022 | 16900 | 590 |
| Total fractions | 100.0 | 0.8189 | 7600 | 350 |

TABLE 4-5/4-6

Properties of each Fraction

| Item | A vol % | B vol % | C | D mm | E wt % | F wt ppm | G wt ppm | H wt % |
|---|---|---|---|---|---|---|---|---|
| {Comp. Example 1} | | | | | | | | |
| LPG | — | — | — | — | — | — | — | — |
| Naphtha | 12.2 | — | — | — | — | — | — | — |
| Kerosene fraction | 22.3 | 0.4 | — | 21.5 | — | — | — | — |
| Gas oil fraction | 28.7 | 3.6 | 60.0 | — | — | — | — | — |
| Atmospheric residue | — | — | — | — | 1.90 | 20 | 13 | 8.8 |
| Vacuum gas oil fraction | — | — | — | — | — | — | — | — |
| Total fractions | — | — | — | — | 0.62 | 9.8 | 6.0 | — |
| {Comp. Example 2} | | | | | | | | |
| LPG | — | — | — | — | — | — | — | — |
| Naphtha | 15.1 | — | — | — | — | — | — | — |
| Kerosene fraction | 23.2 | 0.2 | — | 20.0 | — | — | — | — |
| Gas oil fraction | 30.1 | 4.1 | 58.8 | — | — | — | — | — |
| Atmospheric residue | — | — | — | — | 1.91 | 21 | 13 | 8.6 |
| Vacuum gas oil fraction | — | — | — | — | — | — | — | — |
| Total fractions | — | — | — | — | 0.65 | 10.5 | 6.2 | |
| {Comp. Example 3} | | | | | | | | |
| LPG | — | — | — | — | — | — | — | — |
| Naphtha | 14.0 | — | — | — | — | — | — | — |
| Kerosene fraction | 23.6 | 0.3 | — | 22.0 | — | — | — | — |
| Gas oil fraction | 13.6 | 2.9 | 69.4 | — | — | — | — | — |
| Vacuum gas oil fraction | — | — | — | — | — | — | — | — |
| Atmospheric residue | — | — | — | — | 2.91 | 23 | 13 | 12.6 |
| Total fractions | — | — | — | — | 1.25 | 9.5 | 5.4 | — |
| {Comp. Example 4} | | | | | | | | |
| LPG | — | — | — | — | — | — | — | — |
| Naphtha | 8.5 | — | — | — | — | — | — | — |
| Kerosene fraction | 20.8 | — | — | 23.5 | — | — | — | — |
| Gas oil fraction | 24.3 | — | 57.0 | — | — | — | — | — |
| Vacuum gas oil fraction | — | — | — | — | — | — | — | — |

TABLE 4-5/4-6-continued

Properties of each Fraction

| Item | A vol % | B vol % | C | D mm | E wt % | F wt ppm | G wt ppm | H wt % |
|---|---|---|---|---|---|---|---|---|
| Atmospheric residue | — | — | — | — | — | 4 | 5 | 5.1 |
| Total fractions | — | — | — | — | — | 1.2 | 1.3 | — |

{Remarks}: A; total aromatic component, B; polycyclic aromatic component, C; Cetane Index, D; smoke point, E; pentane-insoluble portion, F; vanadium component, G; nickel component, H; carbon residue content.

What is claimed is:

1. A process for hydrogenating treating crude oil in the presence of a catalyst, which comprises:

a) hydrogenating said crude oil by consecutively;

i) hydrogenating demetallizing said crude oil in the presence of a catalyst, ii) hydrocracking the demetallized crude oil in the presence of a catalyst, and iii) hydrodesulfurizing the hydrocracked crude oil in the presence of a hydrodesulfurizing catalyst;

b) conducting gas-liquid separation of the hydrodesulfurized product into a gaseous component and a liquid component; and c) hydroreforming the separated gas-phase fluid.

2. The process for hydrogenating treating crude oil according to claim (1), wherein said crude oil is the topped crude oil from which naphtha fraction has been removed in a naphtha fraction separation step.

3. The process for hydrogenating treating crude oil according to claim (2), wherein the naphtha fraction which has been removed from the crude oil in a naphtha fraction separation step is subjected to hydroreforming together with the gas-phase fluid which has been separated from liquid in the as-liquid separation step.

4. The process for hydrogenating treating crude oil according to claim 1, wherein the catalyst of the hydrocracking treatment in step (a) is at least one species selected from the group consisting of the metals belonging to Group 6, 8, 9 or 10 of the Periodic Table, and is supported on a carrier composed of 10 to 90% by weight of iron-containing aluminosilicate and 90 to 10% by weight of an inorganic oxide.

5. The process for hydrogenating treating crude oil according to claim 1, wherein the gas-phase fluid in the course of gas-liquid separation step (b) and the gas-phase fluid after the gas-liquid separation step (b) are subjected to hydroreforming at a pressure in the range lower than the pressure in the hydrodesulfurization treatment in step (a) by 0 to 50 kg·f/cm$^2$ and at a temperature in the range lower than the temperature in the hydrodesulfurization treatment in step (a) by 0 to 100° C.

6. A reformed crude oil or a reformed top crude oil which is produced by mixing the liquid-phase fluid produced from the gas-liquid separation step (b) in the process for hydrogenating treating crude petroleum as set forth in claim 1, and the hydroreformed gas-phase fluid produced in hydroforming step (c) of said process.

7. A mixed reformed crude oil which is produced by mixing the top crude oil which has been reformed in the process as set forth in claim 2, and the naphtha fraction which has been separated in the naphtha separation step.

8. A mixed reformed crude oil according to claim 7, which is produced by mixing the naphtha fraction which has been separated in the naphtha separation step and thereafter hydrodesulfurized, and the topped crude oil which has been reformed.

9. The process for hydrogenating treating crude oil according to claim 1, wherein part of the distillate which is produced by distilling separating the reformed crude oil or the reformed top crude oil as set forth in claim 6, is recycled to hydroreforming step (c) of the gas-phase fluid.

10. The process for hydrogenating treating crude oil according to claim 1, wherein part of the distillate which is produced by distilling separating the mixed reformed crude oil as set forth in claim 7 is recycled to hydroreforming step (c) of the gas-phase fluid.

11. The process for hydrogenating treating crude oil according to claim 1, wherein part of the distillate which is produced by distilling separating the mixed reformed crude oil according to claim 8 is recycled to hydroreforming step (c) of the gas-phase fluid.

12. A process for hydrogenating treating crude oil in the presence of a catalyst, which comprises:

a) hydrogenating said crude oil by consecutively:

i) hydrogenating demetallizing said crude oil in the presence of a catalyst of a Group 5, 6, 8, 9 or 10 metal of the Periodic Table under hydrogen pressure, ii) hydrocracking the demetallized crude oil in the presence of a catalyst of a Group 6, 8, 9 or 10 metal of the Periodic Table, and iii) hydrodesulfurizing the hydrocracked crude oil in the presence of a hydrodesulfurizing catalyst of a Group 5, 6, 8, 9 or 10 metal of the Periodic Table under hydrogen pressure;

b) conducting gas-liquid separation of the hydrodesulfurized product into a gaseous component and a liquid component; and c) hydroreforming the separated gas-phase fluid.

13. The process for hydrogenating treating crude oil according to claim 12, wherein the hydrogenating demetallizing treatment is conducted at a temperature of 300 to 450° C. under a hydrogen partial pressure of 30 to 200 kgf/cm$^2$ at a hydrogen/oil ratio of 200 to 2000 Nm$^3$/kl.

14. The process for hydrogenating treating crude oil according to claim 12, wherein said hydrodesulfurization is conducted at a temperature of 300 to 450° C., a hydrogen partial pressure of 30 to 300 kg·f/cm$^2$ and a hydrogen/oil ratio ranging from 200 to 2000 Nm$^3$/kl.

* * * * *